US009365311B1

(12) United States Patent
Sibbett

(10) Patent No.: US 9,365,311 B1
(45) Date of Patent: Jun. 14, 2016

(54) HOLDER HAVING MULTIPLE CARRY DEVICES AND REMOVABLE FRONT CASE FOR USE WITH PHOTOGRAPHIC ITEMS

(71) Applicant: Gary M. Sibbett, Clovis, CA (US)

(72) Inventor: Gary M. Sibbett, Clovis, CA (US)

(73) Assignee: Packetek, Inc., Clovis, CA (US)

( * ) Notice: Subject to any disclaimer, the term of this patent is extended or adjusted under 35 U.S.C. 154(b) by 0 days.

(21) Appl. No.: 14/563,932

(22) Filed: Dec. 8, 2014

Related U.S. Application Data

(60) Provisional application No. 62/075,873, filed on Nov. 5, 2014.

(51) Int. Cl.
*B65D 85/00* (2006.01)
*B65D 5/42* (2006.01)
*B65D 51/00* (2006.01)

(52) U.S. Cl.
CPC . *B65D 5/42* (2013.01); *B65D 51/00* (2013.01)

(58) Field of Classification Search
USPC ..... 206/454, 455
See application file for complete search history.

(56) References Cited

U.S. PATENT DOCUMENTS 3,091,327 A * 5/1963 Lalley ..... G03B 21/64 206/455
3,508,484 A * 4/1970 Hickey ..... G03D 15/027 206/229
3,933,268 A * 1/1976 Buske ..... B65D 21/0202 206/504
4,266,834 A * 5/1981 Ackeret ..... G02B 27/024 206/387.12
D262,412 S 12/1981 Sibbett
4,413,734 A * 11/1983 Newcombe, Jr. ..... B65D 5/326 206/455
5,170,903 A * 12/1992 Fleming ..... B65F 1/141 220/23.4
5,316,159 A * 5/1994 Douglas ..... B65D 21/0204 206/432
5,381,916 A * 1/1995 Strawder ..... B65D 21/0202 220/212
6,644,488 B1 * 11/2003 Coleman ..... B65D 21/0204 206/800
2005/0045630 A1 * 3/2005 Lowance ..... B29C 49/0073 220/23.83
2009/0090711 A1 * 4/2009 Barcham ..... B65F 1/0053 220/23.4
2010/0170897 A1 * 7/2010 Gold ..... B65D 21/0204 220/23.4

OTHER PUBLICATIONS

Picture Pocket package—front & back, U.S.

* cited by examiner

*Primary Examiner* — Jacob K Ackun
(74) *Attorney, Agent, or Firm* — Richard A. Ryan

(57) ABSTRACT

A holder for receiving, storing and carrying photographic items such as cameras, printers, film packs or photographic prints. The holder has a front/distal case that is removably connected to a back/proximal case so that the two cases can be used together or separately. A pair of side members extend rearward from the front case to engage the side walls of the back case or the side members extend forward from the back case to engage the side walls of the front case. The cases are configured be used with various carrying devices that allow the user to carry the holder or one of the cases thereof. In one embodiment, the front case has a back section with a divider that defines separate areas for a film pack and prints and a front section that pivots to open or close the front case and allow access to the items.

7 Claims, 14 Drawing Sheets

HOLDER HAVING MULTIPLE CARRY DEVICES AND REMOVABLE FRONT CASE FOR USE WITH PHOTOGRAPHIC ITEMS

CROSS-REFERENCE TO RELATED APPLICATIONS

This patent application claims priority to U.S. Provisional Application Ser. No. 62/075,873 filed Nov. 5, 2014.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to holders having two or more storage compartments which are sized and configured for removably receiving photographic items therein. In particular, the present invention relates to such holders that are configured for use with multiple carrying devices, such as being clipped on to the user's belt, carried on the user's shoulder by a strap or held on to the user's arm by an arm band. Even more particularly, the present invention relates to such holders that have at least a back case and a front case, with the front case being removably attached to the back case and adaptable to being carried separately from the back case.

B. Background

Apparatuses for holding items and for carrying such items by the user of the apparatus are commonly available. Generally, such holding apparatuses, hereinafter referred to as holders, are configured with one or more walls that define a storage compartment in which items are removably received and stored and/or carried between uses of the items. These holders are typically configured with a carrying device that allows the holder to be easily carried by the user, typically in a hands-free manner. One such carrying device is a clip that is positioned on a rear surface of the holder that allows the holder to be secured to the user's belt, pants, pocket or other clothing location. Alternatively, the carrying device may comprise a loop attached to the rear surface of the holder that is sized to receive the user's belt through the loop to carry the holder on the belt. Another common carrying device is an elongated strap that allows the user to carry the holder on one of his or her shoulders or across his or her neck. Another type of carrying device is an arm band, which may be made out of an elastic material, that allows the user to secure the holder to part of his or her arm, such as the wrist, forearm or upper arm. Although most holders are provided with only one of these carrying devices, some holders have two or more carrying devices.

As well known in the art, most holders have a plurality of walls that define either a generally rectangular or square shaped container with a like-shaped storage compartment therein being defined by the walls of the holder. The back wall has a rearward facing outer surface that is generally positioned or held against the user by the carrying device when the user is using the holder to hold and transport items in the storage compartment. The side and front walls of the holder generally face away from the user and are often decorated, whether being painted, etched or covered with material or the like, as desired by the manufacturer and/or user. The storage compartment is usually sized and configured to hold one or more of the items for which the holder was specifically designed to receive, store and transport. Although it is common to have a single storage compartment inside the holder, being specifically defined by the walls of the holder, many holders have two or more storage compartments inside the walls. Often, the multiple storage compartments are provided by subdividing the internal area of the holder, which may result in sub-compartments that are the same or different size. Alternatively, the multiple storage compartments may result from providing one or more separate storage areas inside the main storage compartment of the holder. The use of this type of holder is particularly common for carrying items that comprise a relatively large item and multiple smaller items that are associated with the large item, such as carrying a camera and various batteries and electronic storage cards for use with the camera.

As well known in the art, it is also relatively common to have a holder with an internal compartment that is defined by the walls of the holder and a second or outer compartment that is attached to or integral with the outer surface of one or more of the walls. Such holders are also useful for carrying a relatively large item in the internal compartment and one or more smaller items that can be used with or which are otherwise associated with the large item in the outer compartment. As before, one example of such a holder are those that are configured for use with modern cameras. Such holders allow the user to carry the camera in the larger internal compartment and the batteries, memory cards or other items that may be beneficially utilized with the camera in the smaller outer compartment. An example of such a holder is set forth in U.S. Pat. No. D262,412 to Sibbett (also the inventor of the holder of the present invention). This holder was configured for use with photographic film and prints, particularly the type of film and prints which are of the instant developing type sold by Polaroid and others. The design of the above-identified patent was the subject of a product sold as the Picture Pocket™ in the early to mid-1980s. The holder was formed into two compartments out of one compartment by the insertion of a divider wall, which was positioned so as to create a relatively large back compartment and a relatively small front compartment. A lid for enclosing the back compartment was pivotally attached to the divider. A lid for enclosing the front compartment was pivotally attached to the front wall of the holder. The product was provided with a clip device on the back wall of the holder for attachment to the user's belt or other object and slots in each of a pair of small tabs that extended rearward from the back wall of the holder for use with a shoulder strap or the like. On the packaging for the product, it was promoted for use to store a package of film in the larger back compartment and for placement of the prints from the camera, as they developed or processed into a picture and after the prints developed, in the smaller front compartment.

The above-described product solved several major issues with regard to the use of instant cameras, namely where to carry an extra package of film for use when the film in the camera is used up, where to place the self-developing prints as they processed into photographs and where to store the prints after they developed. When using these instant cameras, it was always beneficial to carry an extra pack of film as most packages were only able to provide a limited number, typically eight to twelve or so, of self-developing prints before a new package of the prints needed to be placed into the camera.

With regard to the prints themselfs, it was necessary to allow the prints to develop without being exposed to sunlight or being touched, mishandled (i.e., bent, folded or the like) or exposed to fluids. As well known with regard to this type of film, it was also important not to mishandle a print or expose it to water even after the print finished developing. Most people tended to place the developing and developed prints in a pocket of an item of clothing or on a table, counter or other surface. Unfortunately, these places were not always that safe for the prints. The advent of digital cameras and technology related thereto, with the advantages of such technology, resulted in the instant print cameras generally falling out of use in the late 1980s to early 1990s.

Relatively recently, cameras that utilize instant developing film to take, eject and develop a photographic print have made a comeback. Although the cameras and film generally work about the same, with improved technology the quality of the cameras and the film have resulted in a much better product. As with the older Polaroid-type cameras and film, special self-developing film is placed in the camera, a picture is taken using the camera, an undeveloped photographic print pops out of the camera and then the print develops into a developed print over a relatively short amount of time (typically 60 seconds or so). During the time while the print is self-developing, the user must be careful not to touch the photograph portion, expose it to sunlight or contact it with water or other fluids. To help the user avoid touching the photograph portion, the print is provided with a border that surrounds the photograph. Generally, part of the border is of sufficient size that the user can write on it to describe the subject of the photograph, put the date thereon, autograph it or otherwise annotate it.

The new instant developing cameras, as well as other electronic cameras (including many cellular or smart phones), have a number of items that can be used with the camera. For instance, the instant developing cameras require the special self-developing film which, when used up in the camera, must be replaced. Therefore, it was generally advantageous for the person to carry an extra pack of the special film with them when using the instant developing features of the camera. In addition, when a photograph is taken and the print ejected from the camera, the photographic prints themselves must be placed somewhere. As stated above, as these prints develop they must be placed where they can safely process into the developed print without being touched, mishandled or exposed to fluids. Once developed, the photographic prints must be stored in a place where they will not be damaged or exposed to fluids. The instant and other cameras require batteries or a battery pack to power the operation of the camera. Often, it is beneficial to have a backup supply of batteries or a backup battery pack when using the camera. Digital and other cameras, including some of the instant print type, typically store photographs on removable electronic storage media, such as an SD card or the like, that is placed in the camera during use and which can be removed for copying the data (i.e., pictures) to a computer or other device. Recently, a small printer has become available that allows a person to print photographs from a smart phone or other digital photographic device, which may also include cameras, by connecting to the device via a wired or wireless connection (i.e., Bluetooth®) to print self-developing photographs that are somewhat similar to those associated with instant cameras. For purposes of the present application the term "camera" refers to the instant developing cameras, digital cameras and cellular/smart phones having cameras associated therewith. The cameras and the various items that can be used with or which are otherwise associated with these cameras, including film packs, prints (as they develop and after developing), batteries, digital storage media, printers and the like, are herein after collectively referred to as "photographic items".

As well known, the user often does not have a safe and convenient place to store and carry photographic items. Although large cases and the like can be used to carry photographic items, as was commonly done with SLR cameras and the like, most people prefer not to have to lug around a large case when he or she desires to use their camera. What is needed, therefore, is a new holder for carrying photographic items that is sized and configured to be more conveniently carried by the user of the items. The holder should be able to safely store and carry a plurality of photographic items. The improved holder should be adaptable for use with multiple types of carrying devices so the user can choose how he or she desires to carry the holder when using it to store and transport photographic items. The new holder should have multiple compartments for separating and carrying the photographic items. Preferably, the improved holder should comprise separate cases, each having a compartment therein, which can be joined together to carry as one or which can be separated to allow the user to carry only one of the cases when use of both of the cases is not needed or desired. The holder should be configured to be relatively inexpensive to manufacture and, in a preferred configuration, be adaptable for being customized by the user.

SUMMARY OF THE INVENTION

The holder of the present invention provides the benefits and solves the problems identified above. That is to say, the present invention is directed to an improved holder for storing and transporting photographic items while being carried by or on a person. The holder of the present invention comprises two cases, a back case and a front case, that each define a compartment therein which is sized and configured to receive and store one or more photographic items as the items are being carried by the user of the holder. In a preferred configuration, the back case is the larger of the two cases and is used to store and carry items such as a camera, film pack or a printer. The front case, preferably the smaller of the two cases, is used to carry the photograph prints, batteries, electronic storage media and the like. The two cases are removably joined together to form the holder and each case is configured to safely protect the photographic items stored therein. When the two cases are utilized together, the back surface of the front case is positioned against and secured to the front surface of the back case, which then lays against the user. Multiple types of carrying devices can be utilized with the holder to allow the user to store and carry photographic items in the manner which best suits him or her at the time he or she is using the holder and one or more of the photographic items. The front case can be removed from the back case and carried separately when the user only needs to safely store and carry the smaller photographic items, such as the prints, batteries and electronic storage media. The user can select which type of carrying device can be utilized with the front case when the case is being carried separately from the back case. The holder of the present invention can be made out of a wide variety of materials and in a number of different sizes and configurations. As a result, the new holder for photographic items of the present invention can be relatively inexpensive to manufacture. In a preferred configuration, the new holder is adaptable for being customized by the user.

In one embodiment of the present invention, the holder for use with photographic items generally comprises a back or proximal case, a front or distal case and a mechanism for connecting the front case to the back case. The back case has a plurality of walls comprising a front wall, a back wall, a first side wall, a second side wall, a bottom wall and a lid. The walls and the lid are cooperatively configured so as to define a back compartment that is sized and configured to receive one or more photographic items therein. The lid is pivotally attached to at least one of the walls with a pivot mechanism being positioned at or near an upper end of the back case. The pivot mechanism is configured to place the back case in an open condition that allows access to the back compartment or in a closed condition that at least substantially encloses the back compartment. In a preferred embodiment, the lid pivots forward away from the front wall. The front case also has a plurality of walls comprising a front wall, a back wall, a first side wall, a second side wall, a bottom wall and a lid, with the walls and the lid cooperatively configured so as to define a front compartment that is sized and configured to receive one or more photographic items therein. The lid is pivotally attached to at least one of the walls with a pivot mechanism being positioned at or near an upper end of the front case. The pivot mechanism is configured to place the front case in an open condition that allows access to the front compartment or in a closed condition that at least substantially encloses the front compartment. As with the back case, in a preferred embodiment the lid of the front case pivots forward away from the front wall thereof. The connecting mechanism is associated with at least one of the back case and the front case and is configured to removably connect the front case to the back case. The cases connect in a manner that positions the back wall of the front case adjacent the front wall of the back case when the front case is connected to the back case. The connecting mechanism allows each of the back case and the front case to separate so the two case may each be utilized separately.

In one of the preferred embodiments, the connecting mechanism comprises a first side member and a second side member that are attached to or integral with either the back case or the front case. The first side member and the second side member are disposed in spaced apart relation and are sized and configured to define an open receptacle for receiving and engaging the side walls of the other case (i.e., the front case when the side members are associated with the back case or the back case when the side members are associated with the front case). In one embodiment, the connecting mechanism further comprises a transverse member that is configured to engage a bottom wall of either the front case or the back case when the front case is connected to the back case. In a preferred configuration, the inner surfaces of the side members frictionally engage the side walls of the other case. In another embodiment, the first side member and the second side member each have a securing slot that is sized and configured to receive and engage a securing pin that is associated with the side walls of the case that does not have the side members.

To facilitate carrying the holder or one of the two cases alone, each of the back case and the front case has one or more device attachment mechanisms associated therewith. Each of the device attachment mechanisms, whether on the back case, front case or both cases, are structured and arranged to connect to a carrying device selected so as to support one of the back case and the front case on a user who is utilizing either the holder, the back case or the front case to carry one or more photographic items. Example device attachment mechanisms are a clip support member, a strap slot or a mounting engagement slot, wherein the clip support member is configured to support a belt clip, the strap slot is configured to receive an elongated strap and the mounting engagement slot is configured to receive an engagement pin that is attached to a belt clip or an arm band. In a preferred configuration, the back wall of the front case comprises at least two pairs of the strap slots and a pair of mounting engagement slots. The back case can include one or more slot tabs (two being preferred) extending rearward from the back wall of the back case, with each of the slot tabs having a strap slot.

In another embodiment, the holder is particularly useful for storing and carrying a printer, a film pack for the printer and a plurality of developing and/or developed prints. In this configuration, the printer is carried in the back case and the front case has a front section and a back section, with the back section being sized and configured to receive and store a film pack and/or photographic prints. Preferably, the front section is pivotally connected to the back section in a manner that allows the front case to move between a closed position enclosing one or more areas of the back section and an access position allowing easier access to the area(s) of the back section. In a preferred configuration, the back section has a divider element that defines an upper area and a lower area, with the upper area being sized and configured to receive and store a plurality of the photographic prints and the lower area being sized and configured to receive the film pack. The back section can have at least one side engaging wall that extends generally forward from the back wall of the front case, with the side engaging wall being structured and arranged to frictionally engage one of side wall of the front case so as to secure the front section in the closed position. Preferably, the back section has a pair of side engaging walls, with one of the side engaging walls frictionally engaging each of the side walls.

Accordingly, the primary aspect of the present invention is to provide an improved holder for photographic items that has the advantages discussed above and which overcomes the various disadvantages and limitations associated with prior art holders for such items.

It is an important aspect of the present invention to provide a new holder that is specially configured to store and carry a variety of photographic items in a manner which protects the items from damage while in the holder and which is more convenient for the user to carry than existing holders for such items.

It is also an important aspect of the present invention to provide a new holder for storing and carrying photographic items that is configured to be utilized with multiple types of carrying devices, including belt clips, shoulder straps and elastic arm bands, so the user can choose which type of carrying device is most convenient for him or her.

It is also an important aspect of the present invention to provide a new holder for photographic items which comprises a back case and a front case, with the back case being sized and configured to receive, store and carry items such as a camera, film pack or printer and the front case being sized and configured to receive, store and carry items such as photographic prints, batteries and electronic storage media.

It is also an important aspect of the present invention to provide a new holder for photographic items which comprises a back case and a front case that are removably joined to be utilized together as a single unit by one of a variety of different carrying devices, with the front case being able to be separated from the back case and used alone with a carrying device.

It is also an important aspect of the present invention to provide a new holder for photographic items that comprises a back case and a front case, with the front case being removably attached to the back case and specially configured with areas for photographic prints and a film pack which can be utilized with a printer that is being carried in the back case.

It is also an important aspect of the present invention to provide a new holder for photographic items that can be made out of materials which, if desired, result in the holder being relatively inexpensive to manufacture.

Another important aspect of the present invention is to provide a new holder for photographic items that is adaptable to being customized by the user with designs and other materials.

The above and other aspects of the present invention are explained in greater detail by reference to the attached figures and to the description of the preferred embodiments which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials and configurations for the components of the holder and use of the new holder to receive, store and protect a variety of photographic items, those skilled in the art will readily appreciate that the present invention is not so limited.

Figure 16:
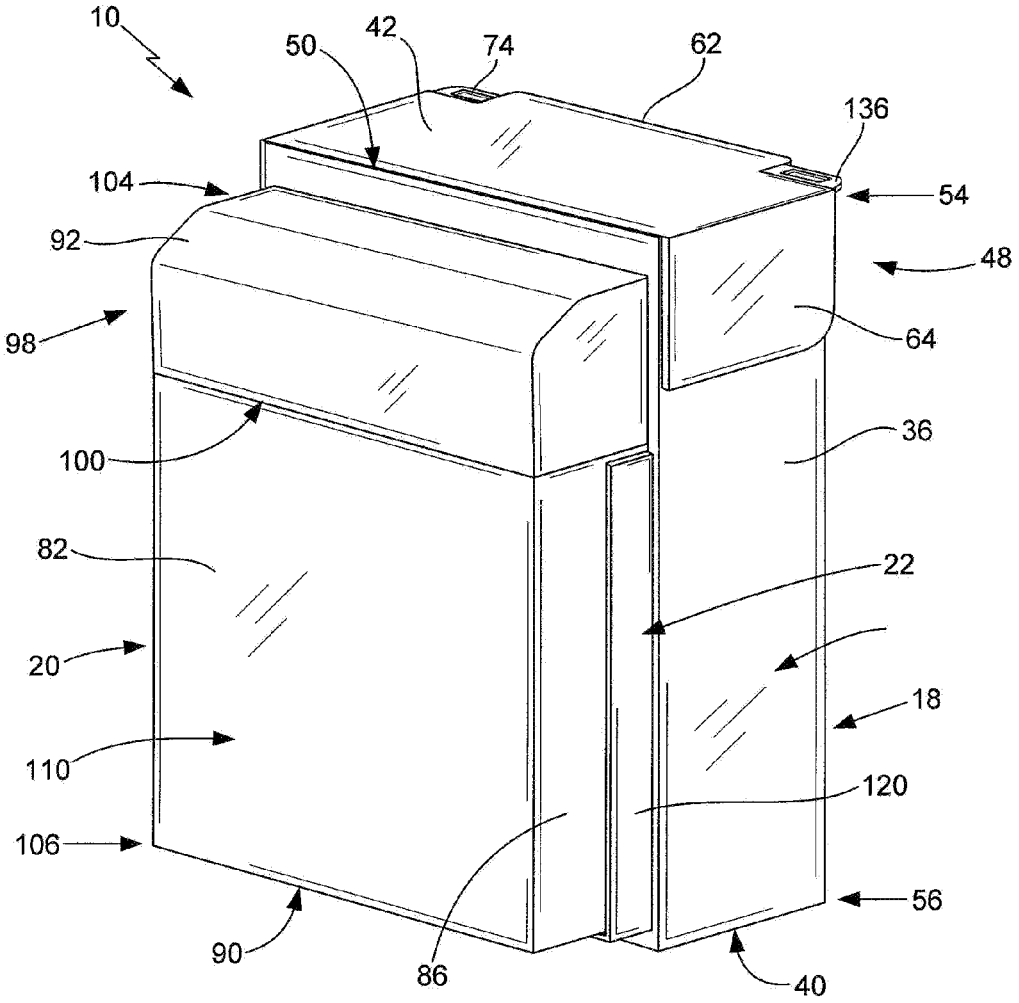
FIG. 16 is a side perspective view of a holder for photographic items that is configured according to a second embodiment of the present invention shown with the front/distal case engaged with the back/proximal case with both cases being in their closed conditions and with the carrying device being a clip that is attached to the back/proximal case and the strap slots being provided in molded tabs which extend rearward from the back surface of the back/proximal case.
Figure 17:
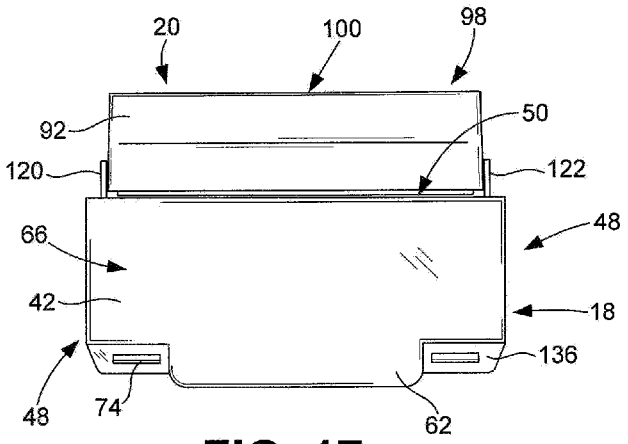
FIG. 17 is a top view of the holder of FIG. 16.
Figure 18:
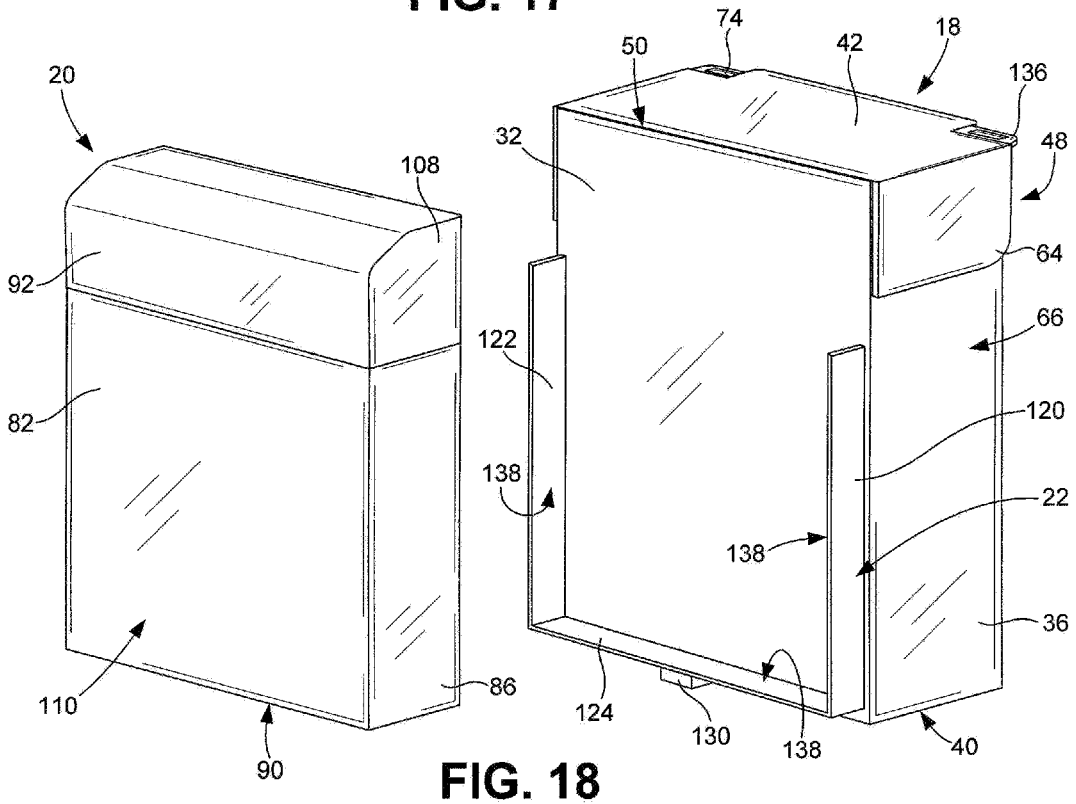
FIG. 18 is a side perspective view of the holder of FIG. 17 with the front/distal case shown separated from the back/proximal case.

A holder that is configured pursuant to a first embodiment of the present invention is shown generally as 10 in FIGS. 1-6 and 9. A second embodiment of the holder 10 of the present invention is shown in FIGS. 16-18. A third embodiment of the holder 10 of the present invention is shown in FIGS. 20-25. As set forth in more detail below, the holder 10 of the present invention is configured for use to receive, store and carry a variety of photographic items, which are collectively identified as numeral 12 in the figures, including the film pack 14, photographic prints 16 and printer 17 shown in FIGS. 6-8 and 22-25. The holder 10 of the present invention comprises two cases, a back or proximal case 18 and a front or distal case 20, with the terms "proximal" and "distal" referring to the relative location of the cases 18/20 to the user's body when the holder 10 is being carried by the user on a belt, over a shoulder, on an arm or elsewhere on his or her body. As is set forth in more detail below, the two cases 18/20 are each structured and arranged to be utilized together, as shown in FIGS. 1-6, to form a single holder 10 that is useful for photographic items 12. Unlike prior art holders, however, the holder 10 of the present invention is also structured and arranged so the two cases 18/20 can be utilized separately to carry such items as the photographic items 12. To accomplish this objective, the two cases 18/20 are configured so the front case 20 removably, but securely, attaches to the back case 18 utilizing a connecting mechanism 22, best shown in FIGS. 9 and 18. As also set forth in more detail below, the holder 10 is adaptable for use with multiple types of carrying devices, which are collectively identified as 24 in FIGS. 2-3, 5-6, 11-12 and 14-15, such as the belt clip 26 shown in FIGS. 2-3, 5-6, 11-12 and 22-23, the arm band 28 shown in FIG. 14 and the elongated strap 30 shown in FIG. 15. The configuration and use of the carrying devices 24 referenced above, as well as other such carrying devices 24 that are or may be suitable for use with holder 10, are generally well known to persons skilled in the relevant art.

Figure 5:
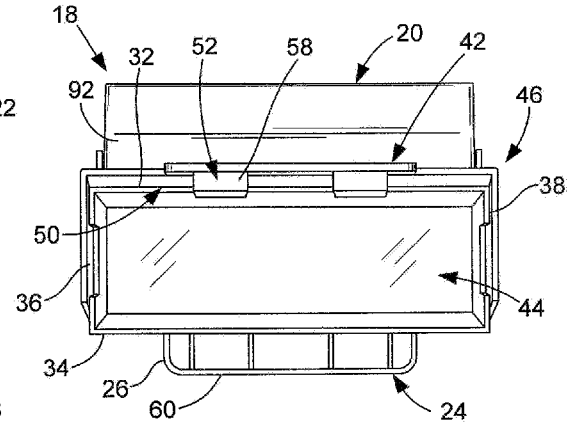
FIG. 5 is a top view of the holder of FIG. 1 with the back/proximal case shown in its open condition.
Figure 6:
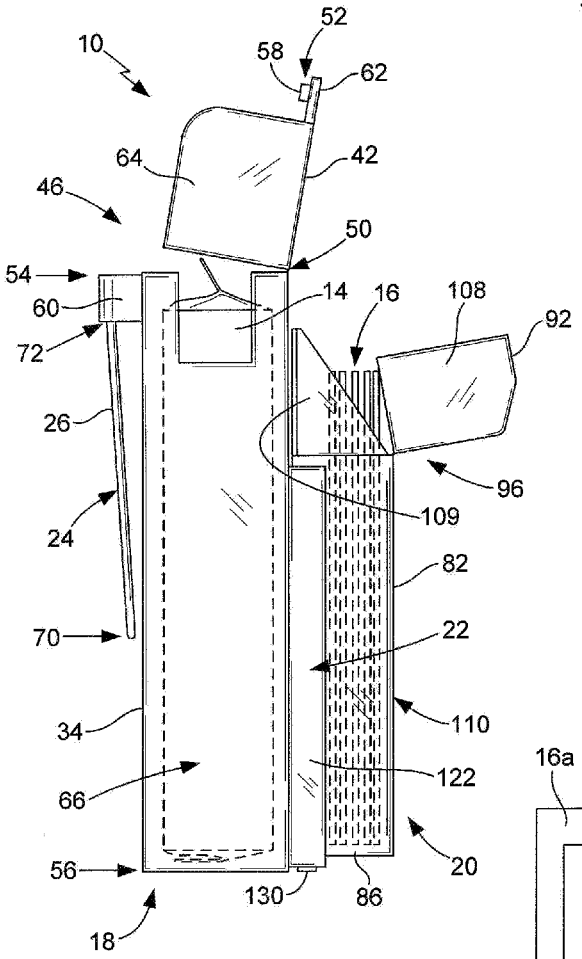
FIG. 6 is a left side view of the holder of FIG. 1 with the back/proximal case and the front/distal case shown in their open conditions with a prior art film package disposed in the back/proximal case and a plurality of prior art prints in the front/distal case.
Figure 7:
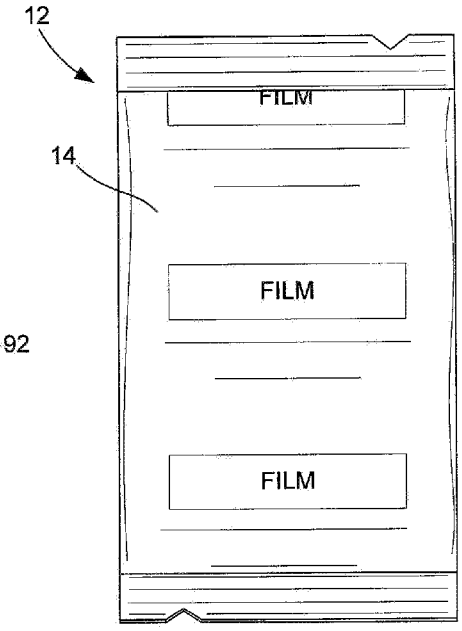
FIG. 7 (PRIOR ART)
FIG. 7 is a front view of the prior art film package of FIG. 6.
Figure 8:
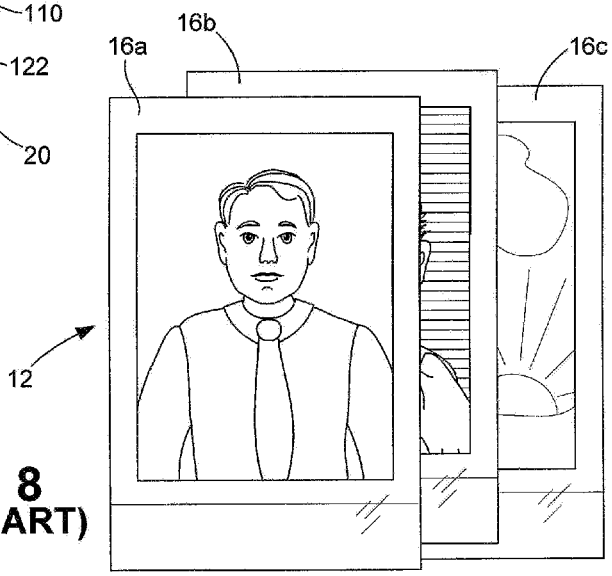
FIG. 8 (PRIOR ART)
FIG. 8 is a front view of the prior art prints of FIG. 6.

The back case 18 has a plurality of walls, namely front wall 32, back wall 34, first side wall 36, second side wall 38, bottom wall 40, and a lid 42 that define a back compartment 44, as shown in FIGS. 1-6, 9 and 16-19. In one use of the holder 10, the back compartment 44 of back case 18 is sized and configured to receive, hold and carry a film pack 14 therein, such as shown in FIG. 6. The back compartment 44 can be specifically sized and configured to carry various other photographic items 12, such as a the printer 17, camera or the like. As will be readily appreciated by persons skilled in the art, a back compartment 44 that is sized and configured to carry one photographic item 12, such as film pack 14, may also be able to be utilized to carry a camera, printer 17 or other photographic items 12. Of course, various other items, including non-photographic items such as a wallet, passport, notepad and the like, may be carried in the back compartment 44, as desired by the user of the holder 10. As explained in more detail below, the back case 18 is also sized and configured, with attachment mechanism 22, to removably receive and support the front case 20, as shown in FIGS. 1-4, 6 and 9. In the embodiment shown in the figures, the attachment mechanism 22 is associated with the front wall 32 of the back case 18 and is structured and arranged to removably attach the front case 20 to the front wall 32 of the back case 18. The back case 18 can be made out of a variety of materials and in a variety of different shapes. For instance, the back case 18 can be made out of plastic, metal, composites and even, if desired for low cost, certain types of paper or cardboard products. In a preferred embodiment of the present invention, the back case 18 is made out of plastic using an injection molding process. Although the back case 18 is shown in the figures as being rectangularly shaped, which may be appropriate for most photographic items 12, including film pack 14, printer 17 and most small cameras, back case 18 can have a variety of sizes and shapes and still accomplish the objectives of the present invention. For instance, if desired the back wall 34 thereof can be slightly curved to better lay against the user.

The lid 42 of back case 18 is configured to be removed or moveably open to place the back case 18 in its open condition 46, shown in FIGS. 5 and 6, to allow access to the compartment 44 and to close place the back case 18 in its closed condition 48, shown in FIGS. 1-4, 9 and 16-19. In the open condition 46, the compartment 44 is open for the user to place photographic items 12 or other items therein and/or to remove the items therefrom. In one embodiment, the lid 42 is fully removable from back case 18. In a preferred embodiment, however, the lid 42 is pivotally attached to one of the front wall 32, back wall 34, first side wall 36 or second side wall 38. In the embodiments shown in the figures, the lid 42 is pivotally attached to the front wall 32 of the back case 18 so the lid 42 will pivot away from the user when he or she pivots the lid 42 so as to move the back case 18 between its open condition 46 and closed condition 48. This configuration will make it easier for the user to place photographic items 12 or other items into the compartment 44 or remove the items therefrom when the holder 10 is secured to the user at his or her waist, hanging around his or her neck or attached to his or her arm. To facilitate movement of the lid 42, back case 18 has a pivot mechanism 50 that interconnects the front wall 32 and the lid 42, as shown in FIG. 5. In the embodiment shown in the figures, the pivot mechanism 50 is a "living hinge" that is added during the manufacturing process (i.e., injection molded plastic). In other embodiments, the pivot mechanism 50 can comprise a separate hinge (not shown) that operates to allow the lid 42 to pivot while being attached to the front wall 32. As well known in the art, a variety of different types of hinges can be utilized for the pivot mechanism 50 to pivotally attach the lid 42 to front wall 32 (or one of the other walls) of the back case 18.

To secure the lid 42 closed when the back case 18 is in its closed condition 46 and prevent any photographic items 12 in compartment 44 from falling out during use of holder 10, the back case 18 includes a locking mechanism 52 that keeps lid 42 against the upper end 54, opposite lower end 56, of the plurality of walls 32/34/36/38 of the back case 18, best shown in FIGS. 5 and 6. In the embodiment shown in the figures, the locking mechanism 52 secures the lid 42 at a position generally at or near back wall 34. More specifically, locking mechanism 52 shown in the figures comprises a pair of outwardly extending locking members 58 on the lower side of the lid 42 that are sized and configured to lockedly engage a clip support member 60 that is used, as set forth below, to support the belt clip 26 on the back case 18. When the lid 42 is closed, the locking members 58 engage the clip support member 60 to lock the back case 18 in its closed condition 48. In the preferred embodiment, the locking members 58 are attached to or integral with an extension area 62 of lid 42, as shown in FIG. 6. As best shown in FIGS. 1-2, 4, 6, 9 and 16-19, the extension area 62 is a part of the lid 42 that generally extends rearward beyond the back wall 34 to cover the clip support member 60 when the back case 18 is in its closed condition 48. In the embodiment shown in the figures, the lid 42 of back case 18 also has a side panel 64 that is attached to or integral with (preferred) the portion of the lid 42 that covers the top of the compartment 44 that provides a more secure and fully closed compartment 44 when the back case 18 is in its closed condition 48. As will be readily appreciated by persons skilled in the art, the back case 18 should have a height (i.e., from upper end 54 to lower end 56) and a width (i.e., between first side wall 36 and second side wall 38) that are sufficient to allow the photographic item 12 and/or other items to fully fit within the interior of the compartment 44 with the lid 42 being able to close in a manner that allows the locking mechanism 52 to engage and lockedly close the back case 18 in its closed condition 48. The back case 18 has outer surfaces 66 that can be painted, covered, coated, imprinted or otherwise decorated as may be desired by the manufacturer and/or the user of holder 10.

As set forth above, a number of carrying devices 24 can be utilized with holder 10 to allow the user to more easily and conveniently carry one or more photographic items 12, including film pack 14 and a plurality of photographic prints 16, as shown in FIG. 6. Carrying device 24 can be a belt clip 26 that is structured and arranged to secure the holder 10 to the user's belt or a belt-like item, including a strap on a backpack or the like, or to other objects, such as the waistband or pocket of the user's pants or other clothing item, associated with or utilized by the user. The configuration and use of belt clips are generally well known in the art. The belt clip 26 utilized with the holder 10, as with other belt clips, is configured to provide a gap 68 between the belt clip 26 and the back wall 34 of the back case 18, as best shown in FIG. 2, in which the belt or other object is received to secure the holder 10 on the belt/object. For use with the holder 10 of the present invention, the belt clip 26 can be a single, integral component with clip support member 60, which can be integral with or fixedly attached to the back wall 34 of the back case 18. In the embodiment shown in FIGS. 1-6, the belt clip 26 is removably received in clip support member 60, which is fixedly attached to or integral with (generally preferred) the back wall 34 of the back case 18. In this embodiment, the lower end 70 of the belt clip 26 is sized and configured to fit through the space between the clip support member 60 and the back wall 34 and the upper end 72 of the belt clip 26 is sized and configured to tightly fit within that space and/or to engage the clip support member 60 in a manner that holds the belt clip 26 securely in place on the back case 18. Once in place, the user can attach the belt clip 26 to his or her belt or onto another object, as set forth above.

Figure 3:
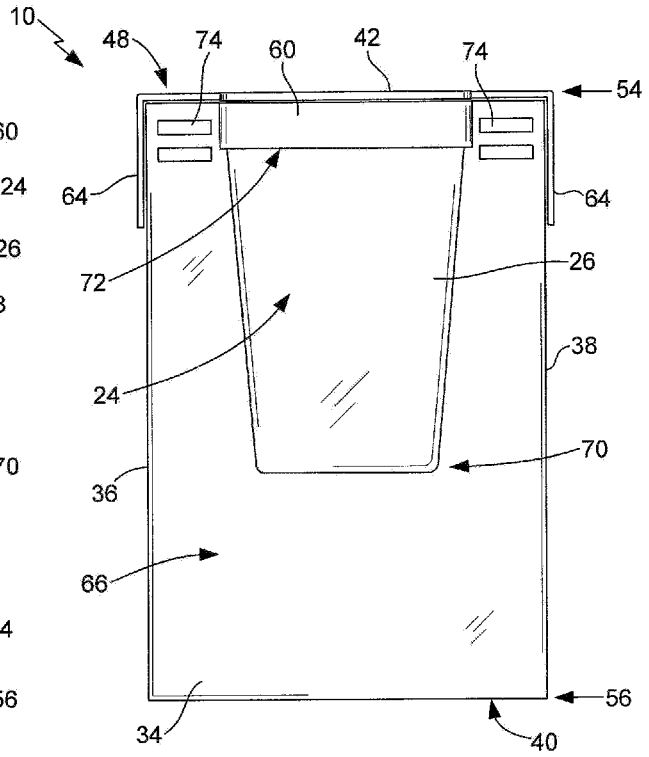
FIG. 3 is a back view of the holder of FIG. 1 particularly showing the clip and the two pairs of strap slots for use with an elongated strap.
Figure 4:
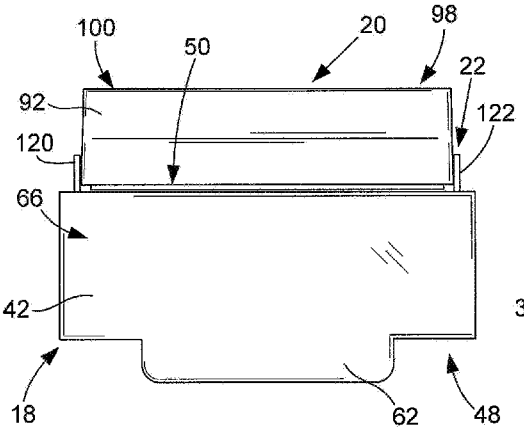
FIG. 4 is a top view of the holder of FIG. 1.
Figure 14:
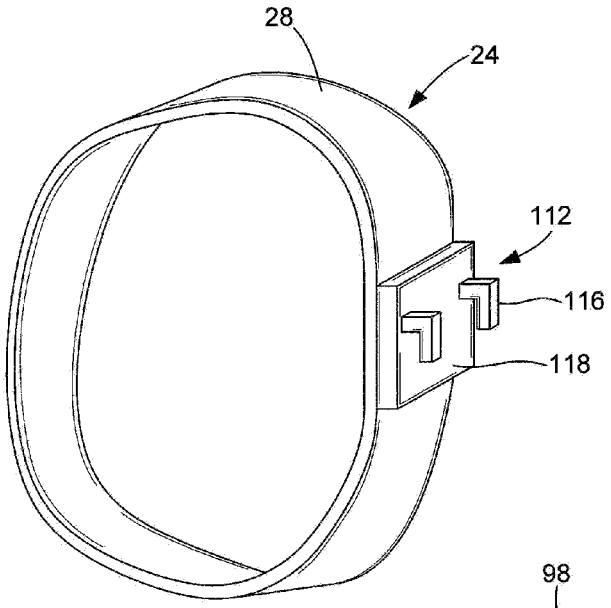
FIG. 14 is a side view of an alternative carrying device configured as an arm band having an elastic strap attached to a case mounting mechanism which engages the mounting engagement slots shown in FIG. 10.
Figure 15:
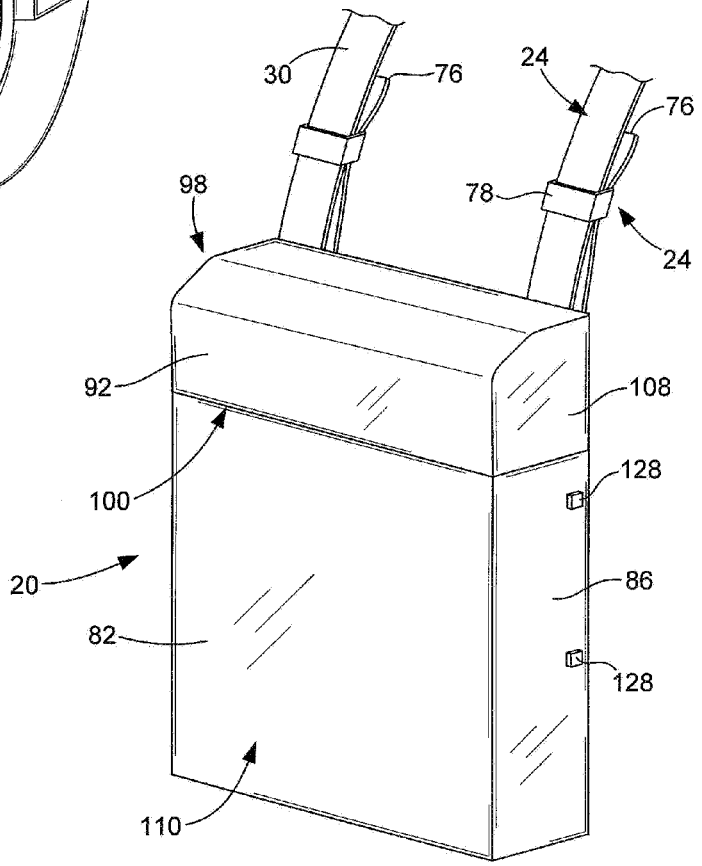
FIG. 15 is a side perspective view of the front/distal case of FIGS. 1-6 and 9 shown with an alternative carrying device configured as an elongated strap that engages the strap slots of FIGS. 3 and 10.

Instead of the belt clip 26, the user can utilize an arm band 28 or an elongated strap 30 to carry holder 10 on his or her person, examples of which are shown and described in use with the front case 20 with regard to FIGS. 14-15. The configuration and use of these and other types of carrying devices 24 are generally well known to persons skilled in the relevant art. For use with the arm band 28, the back case 18 of holder 10 can be attached to the elastic arm band 28 of FIG. 14 by sliding the arm band 28 into the gap 68 between the back wall 34 and the belt clip 26. For use with the elongated strap 30, an example of which is shown in use with the front case 20 in FIG. 15, the back wall 34 of back case 18 can be provided with strap slots 74 that are each sized and configured to receive the elongated strap 30 therethrough so the user can hang the holder 10 from the strap 30 over his or her shoulder. As shown in FIG. 3, the back wall 34 can have a pair of strap slots 74 on each side of the clip support member 60 that are sized and positioned to allow the user to thread the elongated strap 28 through the strap slots 74. Once an end 76 of the elongated strap 30 is threaded through the strap slots 30, the end 76 can be fed through a loop, clip, buckle or other securing member 78, as shown in FIG. 15, to prevent the elongated strap 30 from disengaging from the strap slots 74. As well known in the art, the ends 76 of the elongated strap 30 can be provided with holes, snaps, hook-and-loop material and the like that can be utilized to securely engage the securing member 76.

The front case 20 has a plurality of walls, namely front wall 82, back wall 84, first side wall 86, second side wall 88, bottom wall 90, and a lid 92 that define a front compartment 94, as shown in FIGS. 1-2, 4-6, 9-13 and 15-19. In one embodiment of the holder 10, the front compartment 94 of front case 20 is sized and configured to receive, hold and carry a plurality of photographic prints 16 therein, such as shown in FIGS. 6 and 13. The front compartment 94 can be specifically sized and configured to carry various other photographic items 12, such as batteries, digital memory cards and the like. As will be readily appreciated by persons skilled in the art, a front compartment 94 sized and configured to carry one photographic item 12, such as photographic prints 16, may also be utilized to carry batteries, memory cards or other photographic items 12. Of course, various other items, including non-photographic items such as a drivers license or other ID, cash, credit cards, paper and the like, may be carried in the front compartment 94, as may be desired by the user of the holder 10. As explained in more detail below, the front case 20 is also sized and configured, with attachment mechanism 22, to removably attach to and be supported by the back case 18, as shown in FIGS. 1-4, 6 and 9. As described above, in the embodiment shown in the figures, a portion of the attachment mechanism 22 is associated with the front wall 32 of the back case 18 and is structured and arranged to removably attach the front case 20 to the front wall 32 of the back case 18. As with back case 18, the front case 20 can be made out of a variety of materials and in a variety of different shapes. For instance, the front case 18 can be made out of plastic, metal, composites and even, if desired for low cost, certain types of paper or cardboard products. In a preferred embodiment of the present invention, the front case 20 is made out of plastic using an injection molding process in the same manner as back case 18. Although the front case 20 is shown in the figures as being generally rectangular-shaped, which may be more appropriate for photographic items 12 such as photographic prints 16, the front case 20 can have a variety of sizes and shapes and still accomplish the objectives of the present invention.

The lid 92 of front case 20 is configured to be removed or moveably open to place the front case 20 in its open condition 96, shown in FIGS. 6 and 13, to allow access to the compartment 94 and closed to place the front case 20 in its closed condition 48, shown in FIGS. 1-2, 4, 9-10, 12 and 15-19. In the open condition 96, compartment 94 is open for the user to place photographic items 12 or other items therein and/or to remove the items therefrom. In one embodiment, the lid 92 is fully removable from the front case 20. In a preferred embodiment, as with back case 18, the lid 92 is pivotally attached to one of the front wall 82, back wall 84, first side wall 86 or second side wall 88. In the various embodiments shown in the figures, the lid 92 is pivotally attached to the front wall 82 of the front case 20 so the lid 92 will pivot away from the user when he or she pivots the lid 92 so as to move front case 20 between its open condition 96 and closed condition 98. Such a configuration will make it easier for the user to place photographic items 12 or other items into the compartment 94 or remove the items therefrom when the holder 10 is secured to the user at his or her waist, hanging around his or her neck or attached to his or her arm. To facilitate movement of the lid 92, front case 20 has a pivot mechanism 100 that interconnects the front wall 82 and the lid 92, as shown in FIG. 5. In the embodiment shown in the figures, the pivot mechanism 100 is a "living hinge" that is added during the manufacturing process (i.e., injection molded plastic). In other embodiments, pivot mechanism 100 can comprise a separate hinge (not shown) that operates to allow the lid 92 to pivot while being attached to the front wall 82. As well known in the art, a variety of different types of hinge devices can be utilized for the pivot mechanism 100 to pivotally attach the lid 92 to the front wall 82 (or one of the other walls) of the front case 20.

Figure 1:
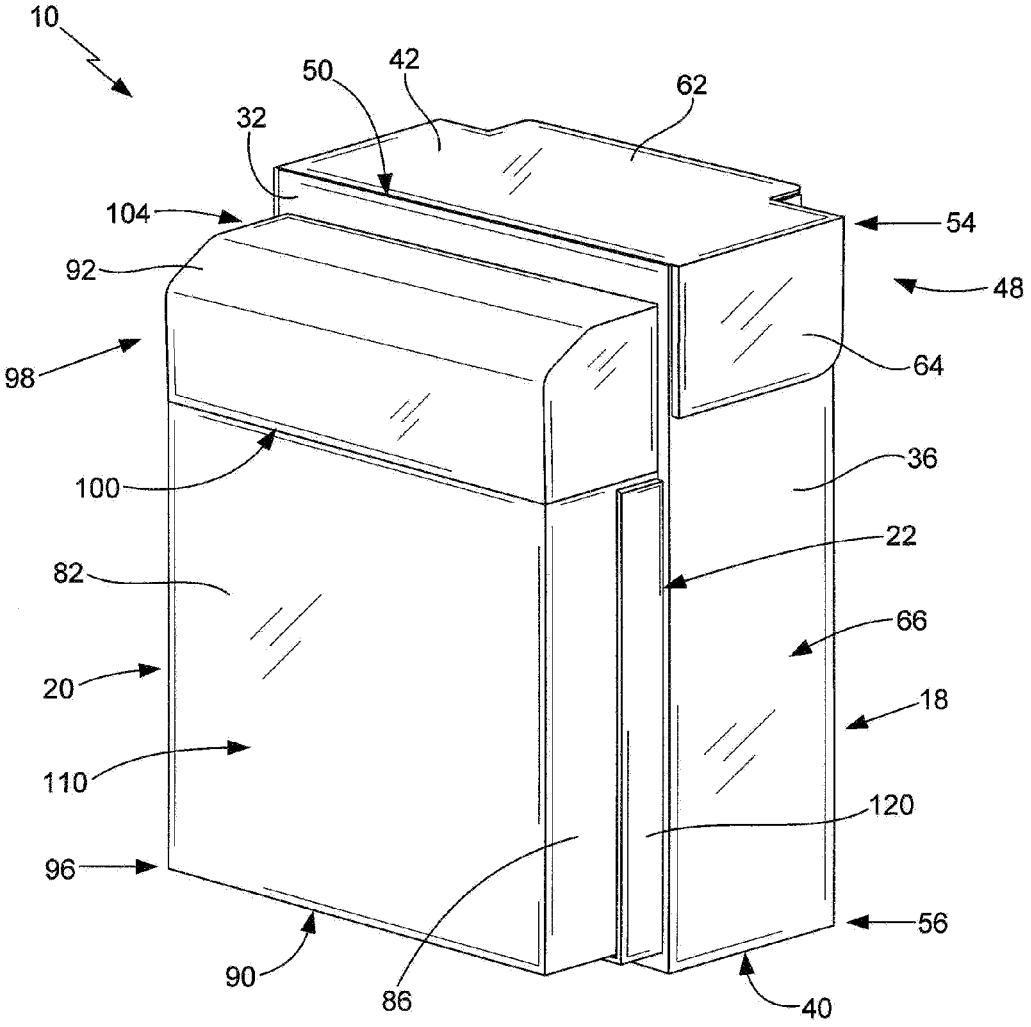
FIG. 1 is a side perspective view of a holder for photographic items that is configured according to a first embodiment of the present invention shown in with both cases in their closed conditions and with the carrying device being a clip attached to the back/proximal case.
Figure 2:
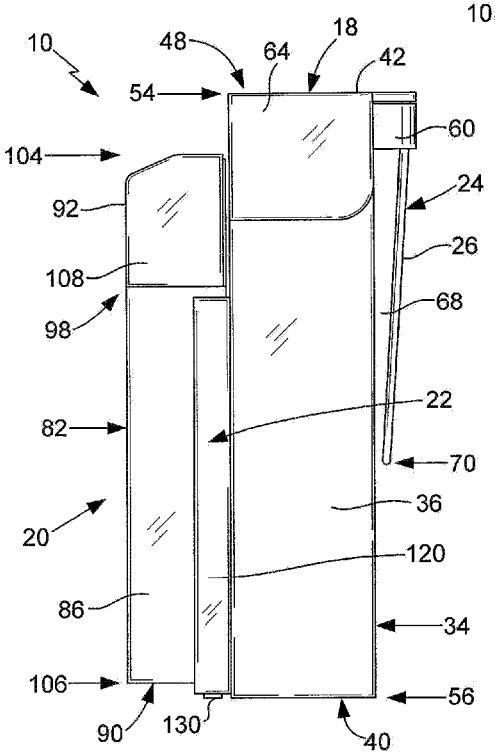
FIG. 2 is a right side view of the holder of FIG. 1.

To secure the lid 92 closed when the front case 20 is in its closed condition 96 and prevent any photographic items 12 in compartment 94 from falling out during use of holder 10, the front case 20 includes a locking mechanism 102 that keeps the lid 92 against the upper end 104, opposite lower end 106, of the plurality of walls 82/84/86/88 of the front case 20, best shown in FIGS. 1, 2 and 6. In the embodiment shown in the figures, the locking mechanism 102 secures the lid 92 at a position generally at or near the back wall 84. More specifically, locking mechanism 102 for front case 20 comprises the frictional engagement between the side panels 108 of the lid 92 and the angled upwardly extending sections 109 of both the first side wall 86 and second side wall 88 at the upper end thereof, the components of which are shown with regard to first side wall 86 in FIG. 6. When the lid 92 pivots at the pivot mechanism 100 to close the compartment 94, the two side panels 108 frictionally engages the two extending sections 109 in a manner that holds the lid 92 closed and keeps the front case 20 in its closed condition 98. As will be appreciated by persons skilled in the art, various other types of locking mechanisms 102 can be utilized with front case 20 to keep it in its closed condition 98 with the lid 92 pivoted closed. The front case 20 should have a height (i.e., from upper end 104 to lower end 106) and a width (i.e., between first side wall 86 and second side wall 88) that are sufficient to allow the photographic item 12 and/or other items to fully fit within the interior of the compartment 94 with the lid 92 being able to close in a manner that allows the locking mechanism 102 to engage and lockedly close the front case 20 in its closed condition 98. The front case 20 has outer surfaces 110 that can be painted, covered, coated, imprinted or otherwise decorated as may be desired by the manufacturer and/or the user of holder 10.

Figure 10:
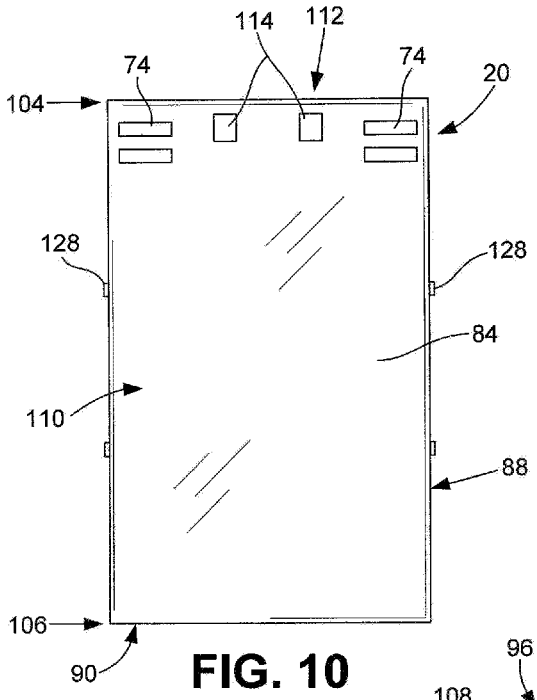
FIG. 10 is a back view of the front/distal case showing the mounting engagement slots and strap slots on the back wall of the front/distal case.
Figure 11:
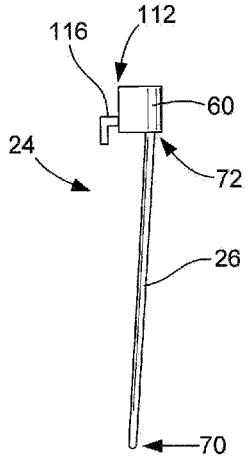
FIG. 11 is a right side view of the clip of FIGS. 1-6 and 9.
Figure 12:
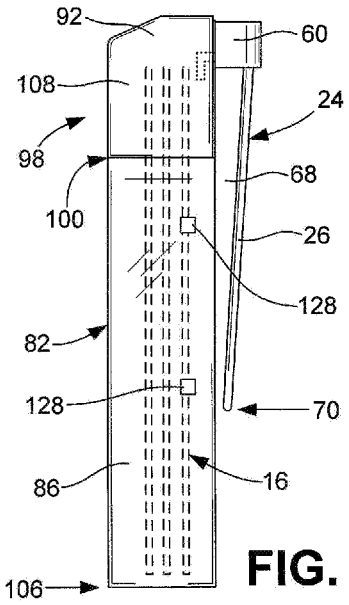
FIG. 12 is a right side view of the front/distal case shown in its closed condition with the clip of FIG. 11 attached and a plurality of prints disposed inside the case.
Figure 13:
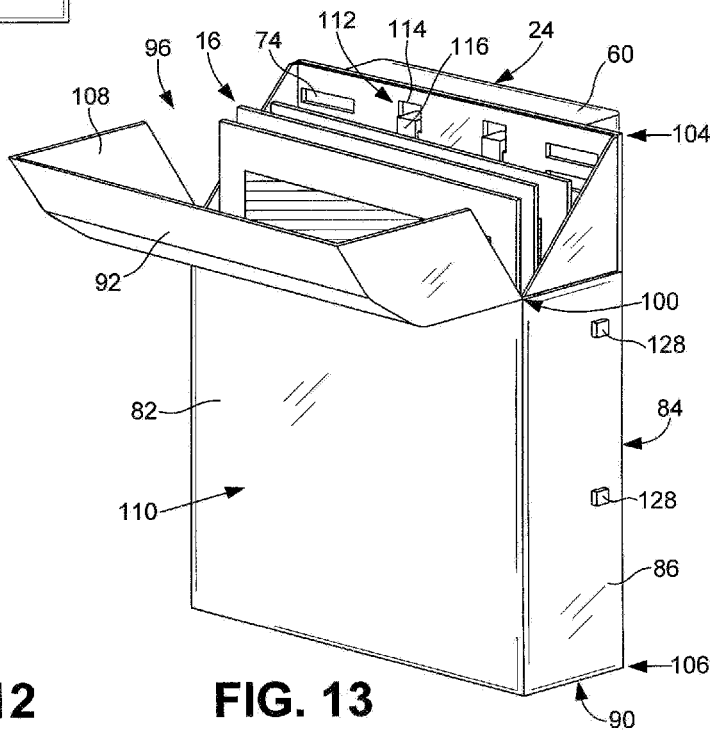
FIG. 13 is a side perspective view of the front/distal case of FIG. 12 shown in its open condition.

As with the holder 10 itself, a number of carrying devices 24 can be utilized with front case 20 to allow the user to utilize just the front case 20 to easily and conveniently carry one or more photographic items 12, including photographic prints 16, as shown in FIGS. 6 and 12-13. The carrying device 24 can be a belt clip 26 that is structured and arranged to secure the front case 20 to the user's belt or a belt-like item, including a strap on a backpack or the like, or to other objects, such as the waistband or pocket of the user's pants or other clothing item, which may be worn or otherwise utilized by the user. The belt clip 26 utilized with front case 20, as with other belt clips generally and with holder 10 itself, is configured to provide a gap 68 between the belt clip 26 and the back wall 84 of the front case 20, as best shown in FIG. 12, in which the belt or other object is received to secure the front case 20 on the belt or other object. For use with the front case 20, the belt clip 26 should be removably attached to the back wall 84 of the front case 20 so that the belt clip 26 will not interfere with attaching the front case 20 to the back case 18 when the cases 18/20 are used together. In the embodiment shown in the figures, the belt clip 26 (attached to or integral with the clip support member 60—as shown in FIG. 11) is a separate component that removably engages front case 20 using a device attachment mechanism 112. As shown in FIGS. 10-13, in one embodiment the attachment mechanism 112 comprises a pair of mounting engagement slots 114 on the back wall 84 of front case 20 that are sized and configured to removably receive and to be engaged by a pair of outwardly extending engagement pins 116 on the back side of the clip support member 60 to removably attach the belt clip 26 to the front case 20, as best shown in FIGS. 10-11 and 13. The mounting engagement slots 114 and the engagement pins 116 are cooperatively sized and configured so the pins 116 will fit within and engage the slots 114 to hold the belt clip 26 on the back wall 84 of the front case 20. In the embodiment shown in the figures, the engagement pins 116 are L-shaped pins that angle downward. The pins 116 are placed in the mounting engagement slots 114 and then the belt clip 26 is moved downward to engage the pins 116 in the slots 114 with the back wall of the clip support member 60 against the back wall 84 of front case 20 to securely, but removably, attach the belt clip 26 to the front case 20. Once in place, the user can attach the belt clip 26 to his or her belt or onto another object, as set forth above. The configuration and use of attachment mechanisms 112 are generally well known in the art. As will be readily appreciated by persons skilled in the art, various other device attachment mechanisms can be utilized to secure the belt clip 26 to the front case 20.

Instead of the belt clip 26, the user can utilize an arm band 28 or an elongated strap 30 to separately carry the front case 20 on his or her person, examples of which are shown in FIGS. 14-15. The configuration and use of these and other types of carrying devices 24 are generally well known to persons skilled in the relevant art. For use with the arm band 28, the front case 20 can attach to the elastic arm band 28 utilizing a device attachment mechanism 112 comprising the engagement pins 116 described above and a strap support member 118, as shown in FIG. 14. The strap support member 118, which functions substantially the same as the clip support member 60 of FIG. 11, is fixedly or moveably (i.e., it can be configured to slide along the arm band 28) to the arm band 28. The two engagement pins 116, which are preferably configured the same as on the belt clip 26 of FIG. 11, extend outwardly from the strap support member 118 to be received in and engage the engagement slots 114 on the back wall 84 of the front case 20. Once connected, the user can carry the front holder 20 on his or her arm or the like to store and transport photographic items 12, such as the photographic prints 16 or, if the front case 20 is large enough, film pack 14 and/or a camera, and/or other items, including drivers license, passport, credit cards, cash and the like. For use with the elongated strap 30, an example of which is shown in FIG. 15, the back wall 84 of front case 20 can be provided with strap slots 74 that are each sized and configured to receive the elongated strap 30 therethrough so the user can hang the front case 20 from the strap 30 over his or her shoulder. As shown in FIG. 10, the back wall 84 can have a pair of strap slots 74 on each side of the mounting engagement slots 114 that are sized and positioned to allow the user to thread the elongated strap 28 through the strap slots 74. Once an end 76 of the elongated strap 30 is threaded through the strap slots 30, the end 76 can be fed through a loop, clip, buckle or other securing member 78, as shown in FIG. 15, to prevent the elongated strap 30 from disengaging from the strap slots 74. As well known in the art, and as set forth above, the ends 76 of the elongated strap 30 can be provided with holes, snaps, hook-and-loop material and the like that can be utilized to securely engage the securing member 76.

Figure 9:
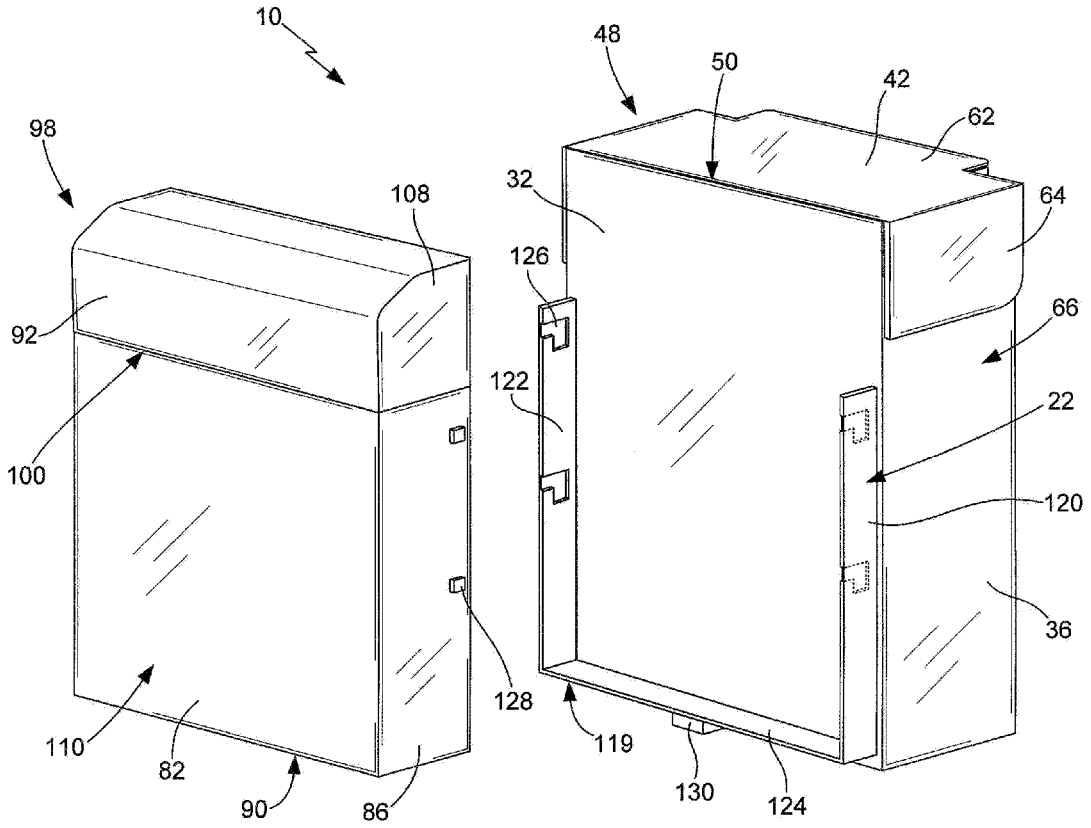
FIG. 9 is a side perspective view of the holder of FIG. 1 shown with the front/distal case separated from the back/proximal case to illustrate the connecting mechanism that joins the two cases together.

As set forth above, one of the primary features of the holder 10 of the present invention is that the front case 20 can be removed from the back case 18 and used alone when the user only needs a small case to store and carry his or her photographic items 12 and/or other items. Although separating the front case 20 from the back case 18 and carrying the front case 20 alone reduces the amount of space available to store and carry items, doing so also significantly reduces the size of the case being carried by the user. To accomplish the objective of being able to quickly and easily remove or reattach the front case 20 from the back case 18, the holder 10 has a connecting mechanism 22 that, while strongly holds the two cases 18/20 together, is easy for the user to operate to separate the cases 18/20. In one embodiment, the connecting mechanism 22 comprises an open receptacle 119, best shown in FIGS. 9 and 18, associated with back case 18 in which the front case 20 is removably received. In the embodiment shown in the figures, the connecting mechanism comprises a generally U-shaped receptacle 119 having a first side member 120, a second side member 122 and a transverse member 124. In this embodiment, each of these members 120/122/124 are fixedly attached to or integral with the front wall 32 of the back case 18 and configured to extend outwardly therefrom. In the embodiment of FIGS. 1-6, 9-10, 12-13 and 15, the connecting mechanism 22 further comprises one or more securing slots 126, with two being shown, in each of the two side members 120/122 and cooperatively configured and positioned securing pins 128 on the side walls 86/88 of the front case 20, as best shown in FIGS. 9-10. The securing slots 126 are configured to receive and retain the securing pins 128 so as to secure the front case 20 on the back case 18 with the back wall 84 of the front case 20 against the front wall 32 of the back case 18, as shown in FIGS. 1-2 and 4-6. In the embodiment shown, the securing slots 126 are generally L-shaped such that the securing pins 128 slide in and then down. In use, the user aligns the securing pins 128 with the opening into the securing slots 126, pushes the back wall 84 of the front case 20 against the front wall 32 of the back case 18 and then slides the front case 20 downward to move the securing pins 128 down in the securing slots 126 until the bottom wall 90 of the front case 20 is, preferably, abutting the transverse member 124 of the open receptacle 119 defined by the members 120/122/124. The use and configuration of this type of connecting mechanism 22 is generally well known in the art.

If desired, the lower surface of the transverse member 124 can be provided with a balance member 130, shown in FIGS. 2, 6, 9 and 18, that is sized and positioned to help allow the holder 10 to stand upright, particularly when the front case 20 is joined to the back case 18. In the embodiment shown in the figures, the balance member 130 is positioned on the lower surface of the transverse member 124 generally at or near the center thereof. The balance member 130, which can be attached to or integral with the transverse member 124, extends downward from the transverse member 124 to contact the surface on which the user places the holder 10 in a manner that helps support the holder 10 in its upright position.

Figure 19:
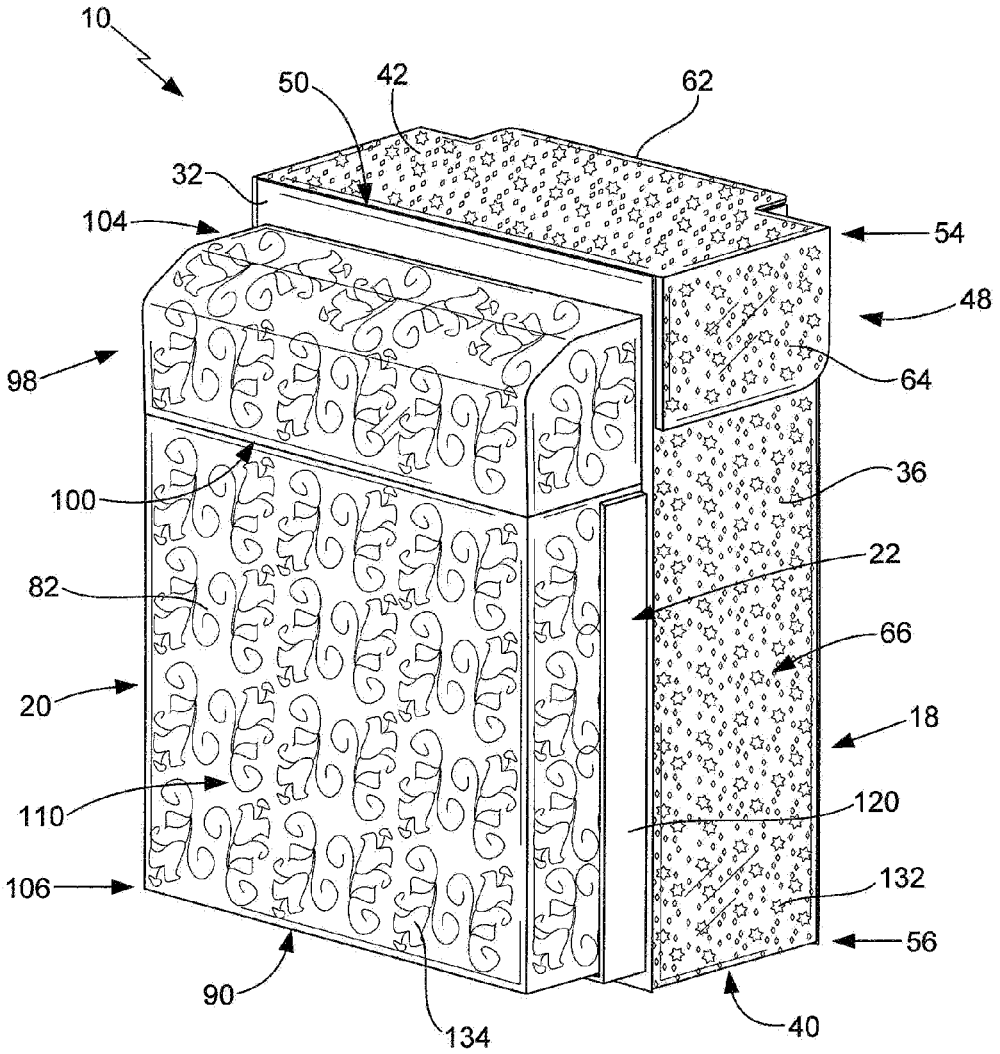
FIG. 19 is a side perspective view of the holder of FIG. 17 shown with the outer surfaces of the two cases having decorations thereon.
Figure 20:
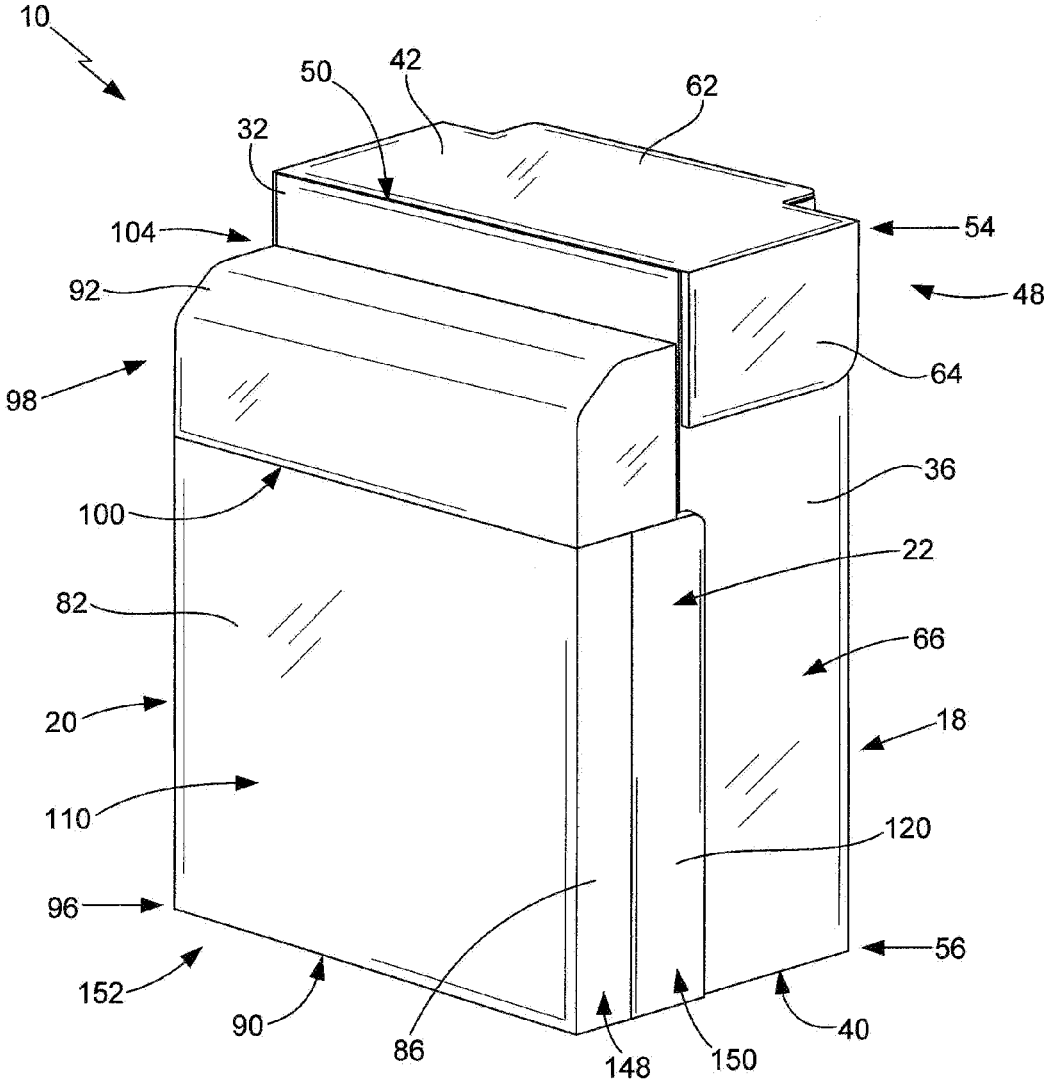
FIG. 20 is a side perspective view of a holder for photographic items that is configured according to a third embodiment of the present invention shown with the front/distal case engaged with the back/proximal case with both cases being in their closed conditions.

As shown in FIG. 19, the outer surfaces 66 and 110 of one or more of the back case 18 and the front case 20, respectively, can be coated, engraved, covered or otherwise decorated, whether completely or partially, with one or more decorative materials to enhance, beautify or personalize the holder 10. As will be readily appreciated by persons skilled in the art and persons who may use the holder 10 of the present invention, the manufacturer and/or the user of the holder can apply one or more decorative items 132 on the back case 18 and/or one or more decorative items 134 on the front case 20 of the holder 10. There is a wide range of materials that can be utilized as the decorative item 132/134. For instance, one or more of the outer surfaces 66/110 of the holder 10 can be coated with paint, leather, chrome or a wide range of coatings and coating-like materials. Depending on the material which the cases 18/20 are made out of, the outer surfaces 66/110 of the holder 10 can be engraved, carved, molded or otherwise modified to include one or more decorative items 132/134. Likewise, the outer surfaces 66/110 can be completely or partially covered with cloth, mesh and/or other fabric or fabric-like materials. Stickers, rhinestones and other types of decorations, including those commonly referred to as "bling," can also be applied to the outer surfaces 66/110 of holder 10. As will be readily appreciated by persons skilled in the art, virtually any type of decorative materials can be utilized for the decorative items 132/134 and these materials may be placed on any of the outer surfaces 66/110 of the cases 18/20 of holder 10. In one embodiment, a kit that comprises a plurality of decorative items 132/134 can be provided separately from the holder 10 to allow the user to more easily and conveniently decorate the back case 18 or front case 20 of his or her holder 10.

A second embodiment of the holder 10 of the present invention is shown in FIGS. 16-18. In this embodiment, each strap slot 74 is positioned in a rearwardly extending slot tab 136 that is attached to or integral with the back wall 34 of the back case 18. The slot tabs 136 are positioned on either side of the clip support member 60 and are sized and configured for the strap slots 74 to fit within the body of the slot tabs 136, the use of which will be readily understood by those skilled in the art. The embodiment of the holder 10 in FIGS. 16-18 is configured with a connecting mechanism 22 that does not utilize the securing slots 126 and securing pins 128 that are best shown in FIG. 9. Instead, as best shown in FIG. 18, the connecting mechanism 22 of this embodiment comprises the inner surfaces 138 of each of the side members 120/122 and the transverse member 124 of the open receptacle 119. The open receptacle 119 formed at the front wall 32 of the back case 18 is cooperatively sized and configured with the front case 20 such that the inner surfaces 138 of the members 120/122/124 will tightly engage the side walls 86/88 and the bottom wall 90 of the front case 20 to securely hold the front case 20 on to the back case 18. As will be readily appreciated by those skilled in the art, it is likely only necessary that the inner surfaces 138 of the side members 120/122 be configured to tightly engage the side walls 86/88 of the front case 20 to secure the front case 20 to the back case 18. In addition to the space between the side members 120/122 being selected so as to engage, preferably tightly, the side walls 86/88 of the front case 20, the material for the inner surfaces 138 of the side members 120/122 and/or the material for the side walls 86/88 can be selected to facilitate the engagement of these components when the user places the front case 20 against the front wall 32 of the back case 18.

Figure 21:
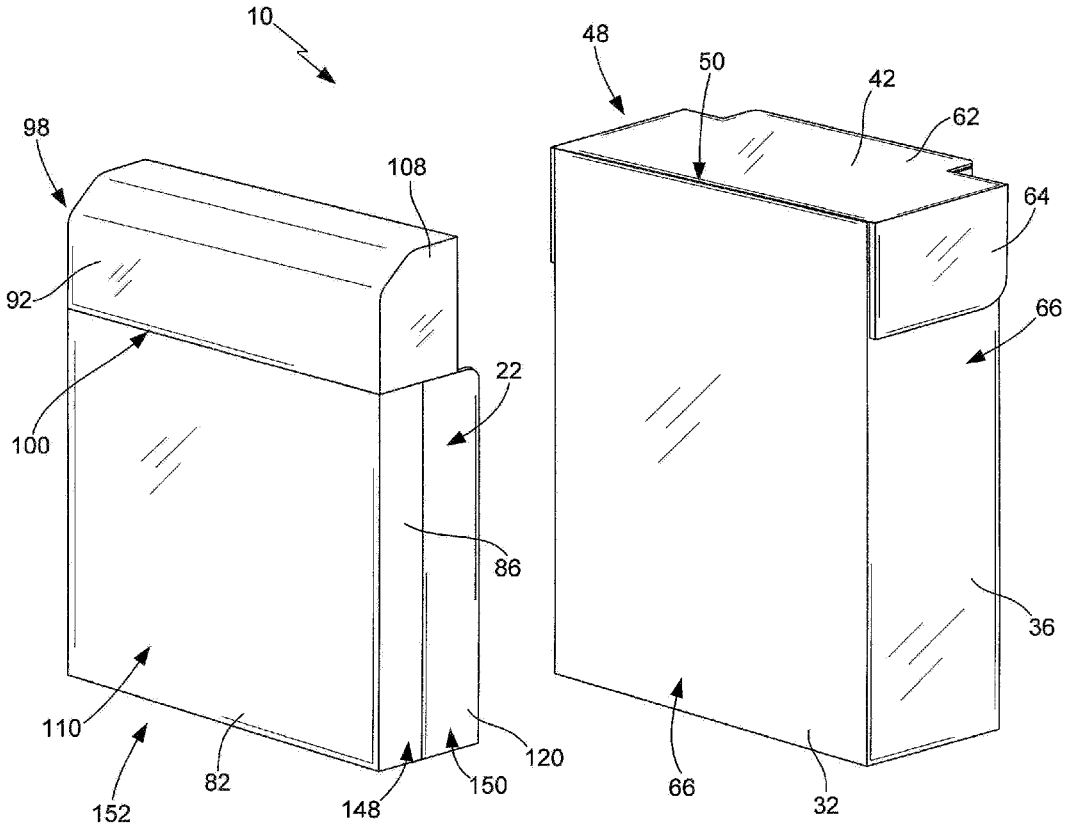
FIG. 21 is a side perspective view of the holder of FIG. 20 with the front/distal case shown separate from the back/proximal case.

A third embodiment of the holder 10 of the present invention is shown in FIGS. 20-25. In this embodiment, the connecting mechanism 22 is configured with the side members 120 and 122 attached to or integral with the side walls 86/88 of the front case 20 (in contrast to being associated with the side walls 36/38 of the back case 18). As described above with regard to the second embodiment, the side members 120/122 are spaced apart such that the inner surfaces 138 of side members 120/122 will tightly engage the side walls 36/38 of the back case 18 to secure the front case 20 to the back case 18. In addition to the space between side members 120/122 being selected to engage, preferably tightly, the side walls 36/38 of the back case 18, the material for the inner surfaces 138 of the side members 120/122 and/or the material for the side walls 36/38 can be selected to facilitate the engagement of these components when the user places the front case 20 against the front wall 32 of the back case 18. One benefit of the configuration of the third embodiment is that the outer surface 66 of the front wall 32 of the back case 18 will be smooth, as best shown in FIG. 21, across the width thereof without the side members 120/122 extending outward from the back case 18, as shown with the previous embodiments of holder 10 in FIGS. 9 and 18. As will be readily appreciated, the smooth outer surface 66 of the front wall 32 provides the user with a more attractive look when the back case 18 is utilized alone (i.e., without the front case 20 attached to the back case 18).

Figure 22:
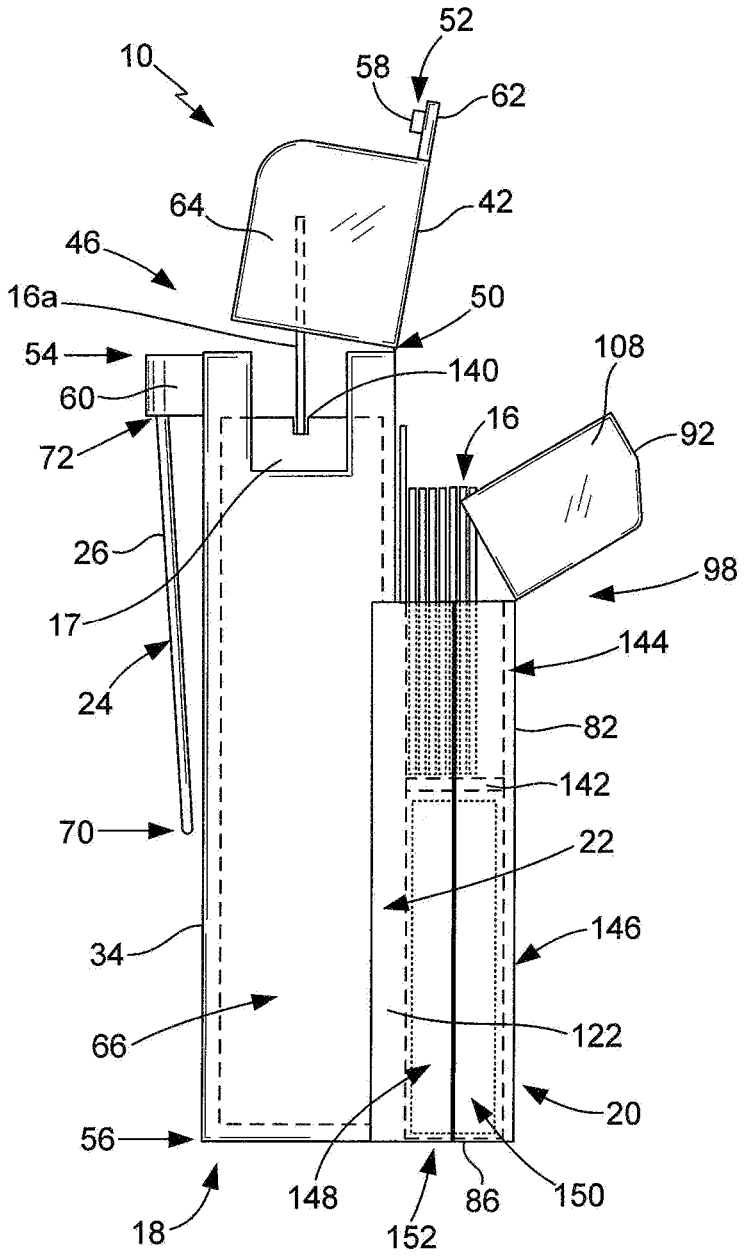
FIG. 22 is a right side view of the holder of FIG. 20 with the each of the back/proximal case and front/distal case shown in their open conditions with a prior art printer disposed in the back/proximal case and a plurality of prior art prints in the front/distal case, with the printer shown ejecting a print therefrom.
Figure 23:
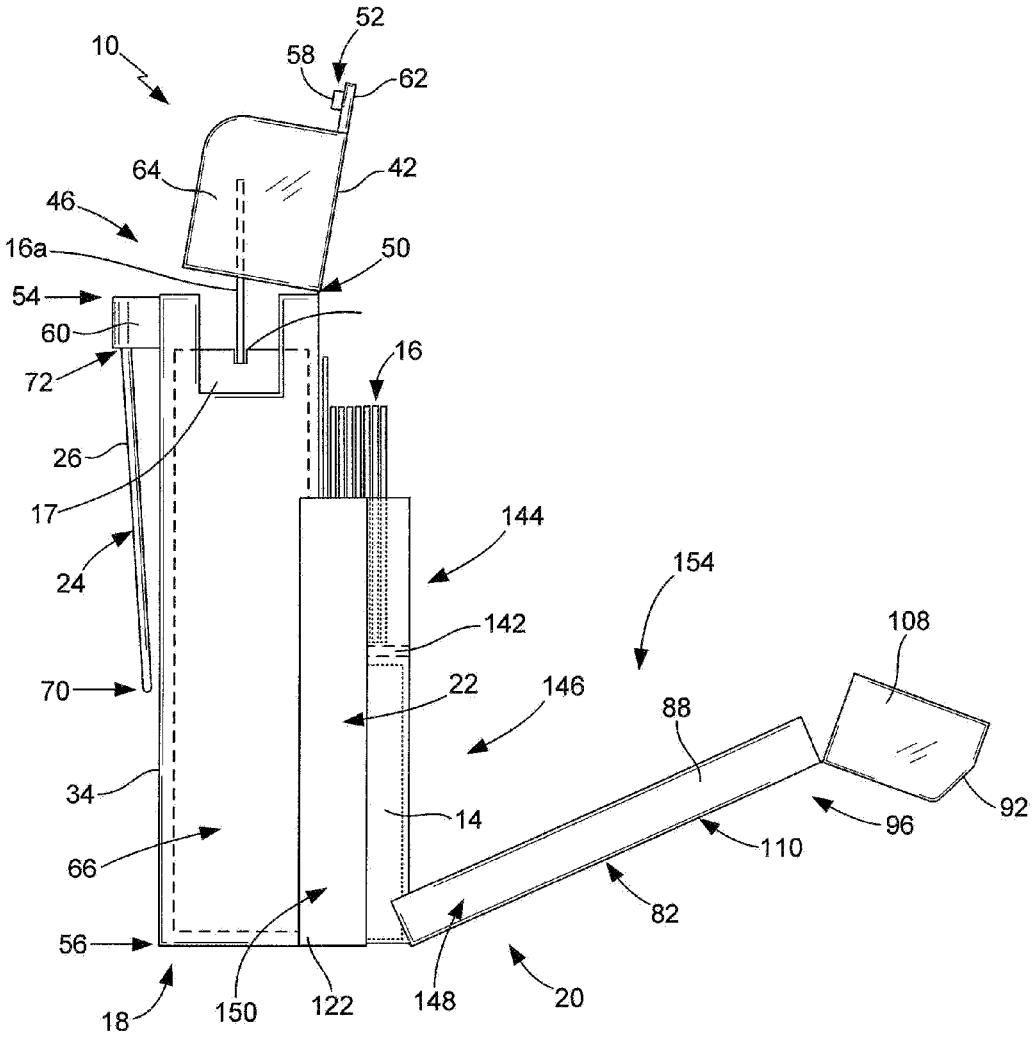
FIG. 23 is a right side view of the holder of FIG. 22 with the front wall of the front/distal case pivoted from its closed position, shown in FIG. 22, to its access position to provide easier access to the photographic prints and film pack stored therein.

As best shown in FIGS. 22-25, this embodiment is also modified to be more useful when the photographic item 12 being carried in the back case 18 is a printer 17 and to be able to carry a film pack 14 for the printer 17 and one or more photographic prints 16 printed by the printer 17 in the front case 20. As shown in FIGS. 22 and 23, the printer 17 can be placed in the compartment 44 of the back case 18 with its discharge slot 140 positioned upward so a new photographic print, shown as 16*a* in FIGS. 22-23, can eject upward out of the discharge slot 140 when the back case 18 is in its open position 46 (i.e., with the lid 42 pivoted open). As will be familiar to many users and persons skilled in the relevant art, relatively recently a number of new printers are available that are small sized so as to be easily portable and are configured to produce photographic prints therefrom that are of a very good quality. In contrast to the cameras that are configured to eject photographic prints, such as the Polaroid® and similar cameras, these printers are separate from the camera. Like the older film and in contrast to most computer printers, however, once the prints are ejected from the printer they still have time to develop into the final print. These printers can connect to the camera, which may be a cell phone or smart phone, with wires or wirelessly (i.e., by using Bluetooth® or the like). An example of such a printer is the LG Pocket Photo™, which uses the new Zink® (for zero ink) paper. The holder 10 of the present invention can be utilized with this printer and many others like it.

Figure 24:
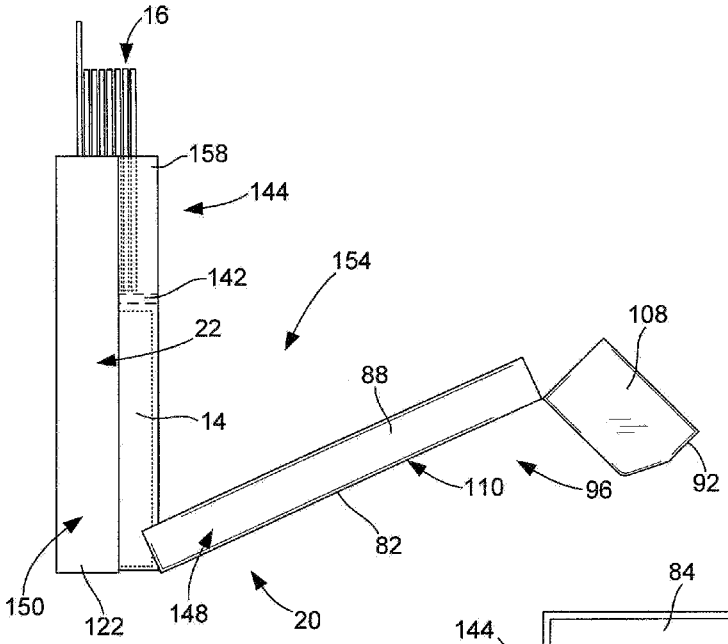
FIG. 24 is a right side view of the front/distal case of the holder of FIG. 23 shown separate from the back/proximal case.
Figure 25:
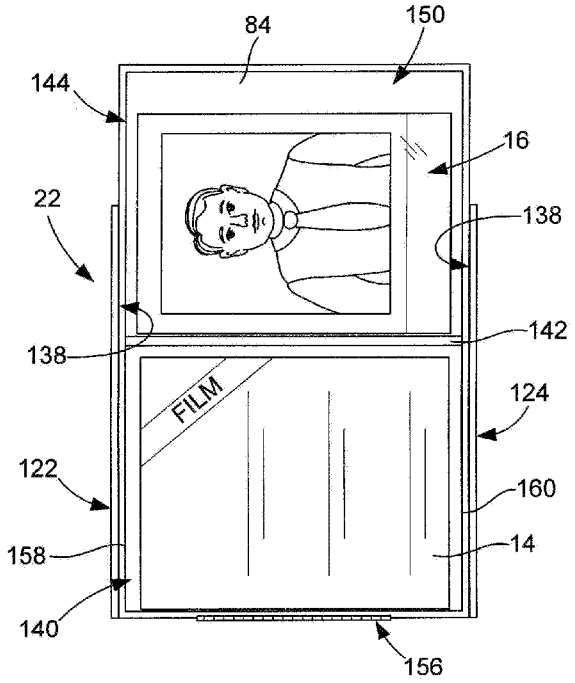
FIG. 25 is a front view of the front/distal case of the holder of FIG. 24, without the front wall thereof, showing the photographic prints and film pack stored in the front/distal case.

In the embodiment shown in FIGS. 22-25, the printer 17 can be placed in the compartment 44 of the back case 18 and the photographic prints 16 that are ejected from the printer 17, as shown with regard to photograph print 16*a* in FIGS. 22-23, can be placed in the compartment 94 of the front case 20. As shown in FIGS. 22-25, the compartment 94 of the front case 20 can be modified to store the photographic prints 16 as they develop and after they have developed and to store a film pack 14 that is used with the printer 17. In one embodiment, the compartment 94 has a divider element 142 that divides the compartment 94 into an upper area 144 that is sized and configured to receive and hold photographic prints 16 and a lower area 146 that is sized and configured to receive and hold a film pack 14, as best shown in FIG. 25. As will be readily apparent to those skilled in the art, the user merely has to flip the lid 92 of the front case 20 to place the front case 20 in its open condition 96 and drop one or more photographic prints 16 into the upper area 144 defined by the divider element 142 and then close the lid 92 to keep the photographic prints 16 in the front case 20 as they develop or after they develop. As will also be appreciated to those skilled in the art, however, access to the film pack 14 in the lower area 146 can be difficult to reach. To facilitate access to the film pack 14, as well as easier access to the photographic prints 16, the front case 20 of this embodiment of the holder 10 is provided with a front section 148 that is pivotally attached to a back section 150 to move the front case 20 between its closed position 152, shown in FIGS. 20-22, and its access position 154, shown in FIGS. 23-24. As with the lids 42/92 of the two cases 18/20, a pivot mechanism 156 interconnects the front section 148 with the back section 150 in a manner that allows the front section 148 to pivot to the access position 154. FIG. 25 is a front view of the back section 150, with the front section 148 removed, showing the photographic prints 16 in the upper area 144, the film pack 14 in the lower area 146, the divider element 142 between the two areas 144/146, the upper portion of the back wall 84 and the pivot mechanism 156. When the front section 148 is pivoted downward, the user can more easily retrieve the film pack 14 from the front case 20.

As with the lids 42/92 of the back case 18 and the front case 20, respectively, various devices can be utilized for the pivot mechanism 156 to pivot the front section 148 towards and away from back section 150, including a "living hinge" or a separate hinge device. The back section 150 can be provided with a pair of outwardly extending side engaging walls, namely first side engaging wall 158 and second side engaging wall 160, as best shown in FIGS. 24-25, that are sized and configured to help enclose the film pack 14 and the photographic prints 16 in the back section 150 and to engage the side walls 86/88 of the front section 148 in a manner that secures, preferably tightly but in a manner in which the user can easily open, the front section 148 against the back section 150 and keeps the front case 20 in its closed position 152, which will prevent the film pack 14 and photographic prints 16 from falling out of the holder 10 as it is being carried or otherwise utilized by the user. If desired, a locking mechanism similar to locking mechanism 52, can be used to secure the front section 148 to back section 150.

In use, the user secures the front case 20 to the back case 18 using the connecting mechanism 22, such as those described above and shown in the figures. Perhaps the easiest and least expensive to manufacture is the connecting mechanism 22 that comprises the side members 120/122 either being integral with the side walls 36/38 of the back case 18 so as to engage the side walls 86/88 of the front case 20 or being integral with the side walls 86/88 of the front case 20 so as to engage the side walls 36/38 of the back case 18. Although both configurations are relatively easy to manufacture and use, the latter (i.e., the third embodiment) has the benefit of the front wall 32 of the back case 18 being smooth, which will generally be more attractive when used alone. The user then connects the carrying device 24 to the holder 10, places the desired photographic items 12 in the compartments of the cases 18/20 and uses the holder 10 to store and carry these items 12 until he or she needs them for use or otherwise desires to remove the items 12 from the holder 10. When the holder 10 is being carried by the user, the lids 42/92 of the two cases 18/20, respectively, can be pivoted open to allow the user to retrieve one or more photographic items 12 from the holder 10 or to place the items 12 into the holder 10. In the preferred embodiments, the lids 42/92 are pivotally attached to the top edge of the front walls 32/82 so as to pivot forward away from the front walls 32/82, as shown in the figures. As also described above, the holder 10 can be utilized to carry larger sized film packs 14, cameras and printers 17, among other items, in back case 18 and developing or developed photographic prints 16 in the front case 20 and/or the holder 10 can be utilized to carry a printer 17 in the back case 18 and both a film pack 14 and developing or developed photographic prints 16. Naturally, the holder 10 can also be utilized to carry money, credit cards, identification cards, passports and/or other items along with the photographic items 12. In the preferred embodiments, the holder 10 of the present invention is relatively inexpensive to manufacture, easy for the user to utilize and a convenient device for holding and carrying photographic items 12.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A holder for use to store and carry one or more photographic items, said holder comprising:

a back case having a plurality of walls, said plurality of walls comprising a front wall, a back wall, a first side wall, a second side wall, a bottom wall and a lid, said plurality of walls and said lid cooperatively configured so as to define a back compartment that is sized and configured to receive at least one of said one or more photographic items, said lid pivotally attached to at least one of said walls with a pivot mechanism being positioned at or near an upper end of said back case, said pivot mechanism configured to place said back case in an open condition allowing access to said back compartment or a closed condition at least substantially enclosing said back compartment;

a front case having a plurality of walls, said plurality of walls comprising a front wall, a back wall, a first side wall, a second side wall, a bottom wall and a lid, said plurality of walls and said lid cooperatively configured so as to define a front compartment that is sized and configured to receive at least one of said one or more photographic items, said lid pivotally attached to at least one of said walls with a pivot mechanism being positioned at or near an upper end of said front case, said pivot mechanism configured to place said front case in an open condition allowing access to said front compartment or a closed condition at least substantially enclosing said front compartment; and connecting means associated with at least one of said back case and said front case for removably connecting said front case to said back case in a manner that at least substantially positions said back wall of said front case adjacent said front wall of said back case when said front case is connected to said back case and allows each of said back case and said front case to be utilized separately when said front case is not connected to said back case, said connecting means comprising a first side member and a second side member attached to or integral with one of said back case and said front case, said first side member and said second side member being disposed in spaced apart relation and sized and configured so as to define an open receptacle for receiving and engaging said side walls of said front case or said side walls of said back case when said front case is connected to said back case, each of said first side member and said second side member of said connecting means further comprising a securing slot that is sized and configured to receive and engage a securing pin associated with one of said side walls of said back case and said side walls of said front case.

2. The holder of claim 1, wherein said connecting means further comprises a transverse member configured to engage a bottom wall of one of said front case and said back case when said front case is connected to said back case.

3. The holder of claim 1, wherein each of said side members have an inner surface, said connecting means configured so said inner surface of each of said side members frictionally engage said side walls of said front case or said side walls of said back case when said front case is connected to said back case.

4. The holder of claim 1, wherein each of said back case and said front case comprise one or more device attachment mechanisms, each of said device attachment mechanisms structured and arranged to connect to a carrying device selected so as to support one of said back case and said front case on a user who is utilizing one of said holder, said back case and said front case to carry said one or more photographic items.

5. The holder of claim 4, wherein said device attachment mechanisms comprise at least one of a clip support member, a strap slot and a mounting engagement slot, wherein said clip support member is configured to support a belt clip, said strap slot is configured to receive an elongated strap, and said mounting engagement slot is configured to receive an engagement pin attached to one of said belt clip and an arm band.

6. A holder for use to store and carry one or more photographic items, said holder comprising:

a back case having a plurality of walls, said plurality of walls comprising a front wall, a back wall, a first side wall, a second side wall, a bottom wall and a lid, said plurality of walls and said lid cooperatively configured so as to define a back compartment that is sized and configured to receive at least one of a film pack and a printer, said lid pivotally attached to at least one of said walls with a pivot mechanism being positioned at or near an upper end of said back case, said pivot mechanism configured to pivot said lid generally forward from said front wall so as to place said back case in an open condition allowing access to said back compartment or a closed condition at least substantially enclosing said back compartment;

a front case having a plurality of walls, said plurality of walls comprising a front wall, a back wall, a first side wall, a second side wall, a bottom wall and a lid, said plurality of walls and said lid cooperatively configured so as to define a front compartment that is sized and configured to receive at least one of a plurality of photographic prints and said film pack, said lid pivotally attached to at least one of said walls with a pivot mechanism being positioned at or near an upper end of said front case, said pivot mechanism configured to pivot said lid generally forward from said front wall so as to place said back case in an open condition allowing access to said front compartment and a closed condition at least substantially enclosing said front compartment;

one or more device attachment mechanisms associated with said back case and/or said front case, each of said device attachment mechanisms structured and arranged to connect to a carrying device selected so as to support one of said back case and said front case on a user who is utilizing one of said holder, said back case and said front case to carry said one or more photographic items; and connecting means associated with at least one of said back case and said front case for removably connecting said front case to said back case in a manner that at least substantially positions said back wall of said front case adjacent said front wall of said back case when said front case is connected to said back case and allows each of said back case and said front case to be utilized separately when said front case is not connected to said back case, said connecting means comprising a first side member and a second side member attached to or integral with one of said back case and said front case, said first side member and said second side member being disposed in spaced apart relation and sized and configured so an inner surface of each of said side members will at least generally frictionally engage said side walls of said front case or said side walls of said back case when said front case is connected to said back case, each of said first side member and said second side member of said connecting means further comprising a securing slot that is sized and configured to receive and engage a securing pin associated with one of said side walls of said back case and said side walls of said front case.

7. A holder for use to store and carry one or more photographic items, said holder comprising:

a back case having a plurality of walls, said plurality of walls comprising a front wall, a back wall, a first side wall, a second side wall, a bottom wall and a lid, said plurality of walls and said lid cooperatively configured so as to define a back compartment that is sized and configured to receive at least one of a film pack and a printer, said lid pivotally attached to at least one of said walls with a pivot mechanism being positioned at or near an upper end of said back case, said pivot mechanism configured to pivot said lid generally forward from said front wall so as to place said back case in an open condition allowing access to said back compartment or a closed condition at least substantially enclosing said back compartment;

a front case having a plurality of walls, said plurality of walls comprising a front wall, a back wall, a first side wall, a second side wall, a bottom wall and a lid, said plurality of walls and said lid cooperatively configured so as to define a front compartment that is sized and configured to receive at least one of a plurality of photographic prints and said film pack, said lid pivotally attached to at least one of said walls with a pivot mechanism being positioned at or near an upper end of said front case, said pivot mechanism configured to pivot said lid generally forward from said front wall so as to place said back case in an open condition allowing access to said front compartment and a closed condition at least substantially enclosing said front compartment;

one or more device attachment mechanisms associated with said back case and/or said front case, each of said device attachment mechanisms structured and arranged to connect to a carrying device selected so as to support one of said back case and said front case on a user who is utilizing one of said holder, said back case and said front case to carry said one or more photographic items; and a pair of side members attached to or integral with one of said back case and said front case, said side members being disposed in spaced apart relation and sized and configured so an inner surface of each of said side members will at least generally frictionally engage said side walls of said front case or said side walls of said back case when said front case is connected to said back case so as to removably connect said front case to said back case in a manner that at least substantially positions said back wall of said front case adjacent said front wall of said back case when said front case is connected to said back case and allows each of said back case and said front case to be utilized separately when said front case is not connected to said back case, each of said side members of said connecting means further comprising a securing slot that is sized and configured to receive and engage a securing pin associated with one of said side walls of said back case and said side walls of said front case.

* * * * *